US012263558B2

(12) United States Patent
Eckel et al.

(10) Patent No.: US 12,263,558 B2
(45) Date of Patent: Apr. 1, 2025

(54) CAMOUFLAGE FOR ABRASIVE ARTICLES

(71) Applicant: 3M INNOVATIVE PROPERTIES COMPANY, St. Paul, MN (US)

(72) Inventors: Joseph B. Eckel, Vadnais Heights, MN (US); Aaron K. Nienaber, Lake Elmo, MN (US); Thomas J. Nelson, Woodbury, MN (US); Amelia W. Koenig, Minneapolis, MN (US); Ann M. Hawkins, Lake Elmo, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 904 days.

(21) Appl. No.: 17/415,789

(22) PCT Filed: Dec. 17, 2019

(86) PCT No.: PCT/IB2019/060954
§ 371 (c)(1),
(2) Date: Jun. 18, 2021

(87) PCT Pub. No.: WO2020/128858
PCT Pub. Date: Jun. 25, 2020

(65) Prior Publication Data

US 2022/0063061 A1 Mar. 3, 2022

Related U.S. Application Data

(60) Provisional application No. 62/781,108, filed on Dec. 18, 2018.

(51) Int. Cl.
*B24D 11/00* (2006.01)
*B24D 11/02* (2006.01)
(Continued)

(52) U.S. Cl.
CPC ..... *B24D 11/005* (2013.01); *B24D 11/02* (2013.01); *B24D 11/08* (2013.01); *B24D 18/0072* (2013.01)

(58) Field of Classification Search
CPC ..... B24D 11/005; B24D 11/02; B24D 11/08; B24D 18/0072
See application file for complete search history.

(56) References Cited

U.S. PATENT DOCUMENTS 1,910,444 A 5/1933 Nicholson
2,141,658 A 12/1938 Melton
(Continued)

FOREIGN PATENT DOCUMENTS

EP 1207015 5/2002
EP 3086903 7/2015
(Continued)

OTHER PUBLICATIONS

International Search Report for PCT International Application No. PCT/IB2019/060613, mailed on Feb. 21, 2020, 4 pages.
(Continued)

*Primary Examiner* — Pegah Parvini

(57) ABSTRACT

Abrasive articles and associated methods are shown that include one or more camouflaging layers that can be applied to a portion of the abrasive article. The one or more camouflaging layers can be applied over the size coat layer as a discontinuous colored layer covering a portion of the size coat layer. In an example, the camouflaging layer can be applied as a repeating pattern of one or more colors on the abrasive article. In an example, the camouflaging layer can be applied randomly to the abrasive article. The discontinuous layer can have a color markedly different than a color of the size coat layer and can be used to mask or minimize an appearance of particle imperfections or voids on the abrasive article. The discontinuous layer can be applicable to coated
(Continued)

and non-woven abrasive articles in the form of sheets, discs, belts, pads, or rolls.

21 Claims, 10 Drawing Sheets

(51) Int. Cl.
*B24D 11/08* (2006.01)
*B24D 18/00* (2006.01)

(56) References Cited

U.S. PATENT DOCUMENTS

| | | | | |
|---|---|---|---|---|
| 3,041,156 | A | 6/1962 | Rowse | |
| 3,058,819 | A | 10/1962 | Paulson | |
| 3,616,580 | A | 11/1971 | Dewell | |
| 3,676,092 | A | 7/1972 | Buell | |
| 3,729,873 | A | 5/1973 | Sandell | |
| 3,784,365 | A | 1/1974 | Caserta | |
| 3,833,346 | A | 9/1974 | Wirth | |
| 3,868,232 | A | 2/1975 | Sioui | |
| 3,869,834 | A | 3/1975 | Mullin | |
| 4,215,516 | A | 8/1980 | Huschle | |
| 4,314,827 | A | 2/1982 | Leitheiser | |
| 4,475,926 | A | 10/1984 | Hickory | |
| 4,623,364 | A | 11/1986 | Cottringer | |
| 4,652,275 | A | 3/1987 | Bloecher | |
| 4,734,104 | A | 3/1988 | Broberg | |
| 4,737,163 | A | 4/1988 | Larkey | |
| 4,744,802 | A | 5/1988 | Schwabel | |
| 4,751,138 | A | 6/1988 | Tumey | |
| 4,770,671 | A | 9/1988 | Monroe | |
| 4,799,939 | A | 1/1989 | Bloecher | |
| 4,881,951 | A | 11/1989 | Wood | |
| 4,997,461 | A | 3/1991 | Markhoff-Matheny | |
| 5,009,675 | A | 4/1991 | Kunz | |
| 5,011,508 | A | 4/1991 | Wald | |
| 5,042,991 | A | 8/1991 | Kunz | |
| 5,078,753 | A | 1/1992 | Broberg | |
| 5,085,671 | A | 2/1992 | Martin | |
| 5,152,917 | A | 10/1992 | Pieper | |
| 5,201,916 | A | 4/1993 | Berg | |
| 5,203,884 | A | 4/1993 | Buchanan | |
| 5,213,591 | A | 5/1993 | Celikkaya | |
| 5,219,462 | A * | 6/1993 | Bruxvoort | B24D 3/28 51/293 |
| 5,269,821 | A | 12/1993 | Helmin | |
| 5,352,254 | A | 10/1994 | Celikkaya | |
| 5,366,523 | A | 11/1994 | Rowenhorst | |
| 5,378,251 | A | 1/1995 | Culler | |
| 5,417,726 | A | 5/1995 | Stout | |
| 5,435,816 | A | 7/1995 | Spurgeon | |
| 5,436,063 | A | 7/1995 | Follett | |
| 5,453,106 | A | 9/1995 | Roberts | |
| 5,496,386 | A | 3/1996 | Broberg | |
| 5,498,268 | A | 3/1996 | Gagliardi | |
| 5,520,711 | A | 5/1996 | Helmin | |
| 5,609,706 | A | 3/1997 | Benedict | |
| RE35,570 | E | 7/1997 | Rowenhorst | |
| 5,672,097 | A | 9/1997 | Hoopman | |
| 5,766,277 | A | 6/1998 | DeVoe | |
| 5,946,991 | A | 9/1999 | Hoopman | |
| 5,954,844 | A | 9/1999 | Law | |
| 5,961,674 | A | 10/1999 | Gagliardi | |
| 5,975,987 | A | 11/1999 | Hoopman | |
| 5,975,988 | A | 11/1999 | Christianson | |
| 5,984,988 | A | 11/1999 | Berg | |
| 6,077,601 | A | 6/2000 | DeVoe | |
| 6,129,540 | A | 10/2000 | Hoopman | |
| 6,228,133 | B1 | 5/2001 | Thurber | |
| 7,553,346 | B2 | 6/2009 | Welygan | |
| 8,034,137 | B2 | 10/2011 | Erickson | |
| 8,080,072 | B2 | 12/2011 | Woo | |
| 8,142,531 | B2 | 3/2012 | Adefris | |
| 8,142,532 | B2 | 3/2012 | Erickson | |
| 8,142,891 | B2 | 3/2012 | Culler | |
| 9,017,150 | B2 | 4/2015 | Keipert | |
| 9,440,332 | B2 | 9/2016 | Gaeta | |
| 9,457,453 | B2 | 10/2016 | Seth | |
| 9,604,346 | B2 | 3/2017 | Breder | |
| 9,776,302 | B2 | 10/2017 | Keipert | |
| 9,969,057 | B2 | 5/2018 | Eugster | |
| 2001/0003884 | A1 | 6/2001 | Wei | |
| 2003/0176156 | A1 * | 9/2003 | Braunschweig | B24D 3/28 451/526 |
| 2009/0165394 | A1 | 7/2009 | Culler | |
| 2009/0169816 | A1 | 7/2009 | Erickson | |
| 2012/0227333 | A1 | 9/2012 | Adefris | |
| 2013/0040537 | A1 | 2/2013 | Schwabel | |
| 2013/0125477 | A1 | 5/2013 | Adefris | |
| 2013/0344786 | A1 | 12/2013 | Keipert | |
| 2014/0106126 | A1 | 4/2014 | Gaeta | |
| 2014/0290147 | A1 | 10/2014 | Seth | |
| 2015/0224629 | A1 | 8/2015 | Moren | |
| 2015/0291866 | A1 | 10/2015 | Arcona | |
| 2016/0311081 | A1 | 10/2016 | Culler | |
| 2016/0311084 | A1 | 10/2016 | Culler | |
| 2016/0315081 | A1 | 10/2016 | Park | |
| 2017/0050293 | A1 | 2/2017 | Gaeta | |
| 2017/0225299 | A1 | 8/2017 | Keipert | |
| 2017/0368667 | A1 | 12/2017 | Keipert | |
| 2018/0029194 | A1 | 2/2018 | Keipert | |
| 2018/0086957 | A1 | 3/2018 | Sahlin | |

FOREIGN PATENT DOCUMENTS

| | | |
|---|---|---|
| EP | 3319758 | 1/2017 |
| WO | WO 2003-008151 | 1/2003 |
| WO | WO 2007-005452 | 1/2007 |
| WO | WO 2011-068714 | 6/2011 |
| WO | WO 2012-112305 | 8/2012 |
| WO | WO 2012-112322 | 8/2012 |
| WO | WO 2014-131937 | 9/2014 |
| WO | WO 2014-176108 | 10/2014 |
| WO | WO 2014-206967 | 12/2014 |
| WO | WO 2015-100018 | 7/2015 |
| WO | WO 2015-100020 | 7/2015 |
| WO | WO 2015-100220 | 7/2015 |
| WO | WO 2016-028683 | 2/2016 |
| WO | WO 2016-044158 | 3/2016 |
| WO | WO 2016-064726 | 4/2016 |
| WO | WO 2016-089675 | 6/2016 |
| WO | WO 2016-205133 | 12/2016 |
| WO | WO 2016-205267 | 12/2016 |
| WO | WO 2017-007703 | 1/2017 |
| WO | WO 2017-007714 | 1/2017 |
| WO | WO 2017-083249 | 5/2017 |
| WO | WO 2017-083255 | 5/2017 |
| WO | WO 2018-080765 | 5/2018 |
| WO | WO 2018-118596 | 6/2018 |
| WO | WO 2018-118690 | 6/2018 |
| WO | WO 2018-118695 | 6/2018 |
| WO | WO 2018-134732 | 7/2018 |
| WO | WO 2018-207145 | 11/2018 |
| WO | WO 2019-215571 | 11/2019 |
| WO | WO 2020-128716 | 6/2020 |
| WO | WO 2020-128717 | 6/2020 |
| WO | WO 2020-128719 | 6/2020 |
| WO | WO 2020-128720 | 6/2020 |
| WO | WO 2020-128752 | 6/2020 |
| WO | WO 2020-128833 | 6/2020 |
| WO | WO 2020-128838 | 6/2020 |
| WO | WO 2020-128842 | 6/2020 |
| WO | WO 2020-128844 | 6/2020 |
| WO | WO 2020-128845 | 6/2020 |
| WO | WO 2020-128852 | 6/2020 |
| WO | WO 2020-128853 | 6/2020 |

(56) References Cited

FOREIGN PATENT DOCUMENTS

| | | |
|---|---|---|
| WO | WO 2020-128854 | 6/2020 |
| WO | WO 2020-128857 | 6/2020 |

OTHER PUBLICATIONS

International Search Report for PCT International Application No. PCT/IB2019/060615, mailed on Feb. 26, 2020, 5 pages.
International Search Report for PCT International Application No. PCT/IB2019/060624, mailed on Mar. 11, 2020, 4 pages.
International Search Report for PCT International Application No. PCT/IB2019/060627, mailed on Jul. 2, 2020, 8 pages.
International Search Report for PCT International Application No. PCT/IB2019/060779, mailed on Mar. 10, 2020, 5 pages.
International Search Report for PCT International Application No. PCT/IB2019/060924, mailed on Apr. 29, 2020, 4 pages.
International Search Report for PCT International Application No. PCT/IB2019/060929, mailed on Mar. 23, 2020, 4 pages.
International Search Report for PCT International Application No. PCT/IB2019/060934, mailed on Mar. 18, 2020, 5 pages.
International Search Report for PCT International Application No. PCT/IB2019/060936, mailed on Mar. 30, 2020, 5 pages.
International Search Report for PCT International Application No. PCT/IB2019/060938, mailed on Apr. 28, 2020, 4 pages.
International Search Report for PCT International Application No. PCT/IB2019/060947, mailed on Mar. 30, 2020, 5 pages.
International Search Report for PCT International Application No. PCT/IB2019/060949, mailed on Jun. 5, 2020, 4 pages.
International Search Report for PCT International Application No. PCT/IB2019/060950, mailed on Mar. 30, 2020, 5 pages.
International Search Report for PCT International Application No. PCT/IB2019/060953, mailed on Apr. 2, 2020, 4 pages.
International Search Report for PCT International Application No. PCT/IB2019/060954, mailed on Apr. 24, 2020, 5 pages.

* cited by examiner

CAMOUFLAGE FOR ABRASIVE ARTICLES

CROSS REFERENCE TO RELATED APPLICATIONS

This application is a national stage filing under 35 U.S.C. 371 of PCT/IB2019/060954, filed Dec. 17, 2019, which claims the benefit of U.S. Provisional Application No. 62/781,108, filed Dec. 18, 2018, the disclosures of which are incorporated by reference in their entireties herein.

BACKGROUND

Abrasive particles and abrasive articles made from the abrasive particles are useful for abrading, finishing, or grinding a wide variety of materials and surfaces in the manufacturing of goods. For example, finishing of welding beads, flash, gates, and risers off castings by off-hand abrading with a handheld right-angle grinder is an important application for coated abrasive discs.

There continues to be a need for improving the cost, performance and other features of the abrasive articles.

BRIEF DESCRIPTION OF THE FIGURES

The drawings illustrate generally, by way of example, but not by way of limitation, various embodiments discussed in the present document.

DETAILED DESCRIPTION

Figure 1A:
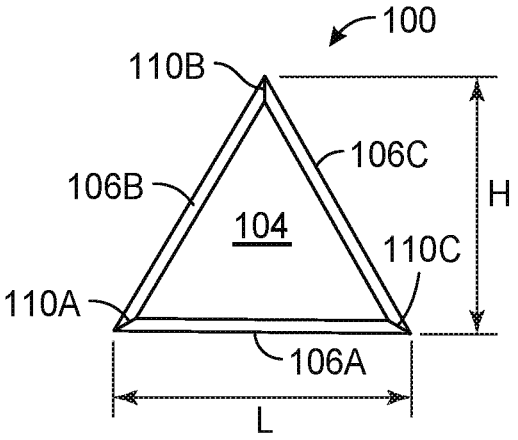
FIGS. 1A-1B are schematic diagrams of shaped abrasive particles having a planar trigonal shape, in accordance with various embodiments.

Reference will now be made in detail to certain embodiments of the disclosed subject matter, examples of which are illustrated in part in the accompanying drawings. While the disclosed subject matter will be described in conjunction with the enumerated claims, it will be understood that the exemplified subject matter is not intended to limit the claims to the disclosed subject matter.

Throughout this document, values expressed in a range format should be interpreted in a flexible manner to include not only the numerical values explicitly recited as the limits of the range, but also to include all the individual numerical values or sub-ranges encompassed within that range as if each numerical value and sub-range is explicitly recited. For example, a range of "about 0.1% to about 5%" or "about 0.1% to 5%" should be interpreted to include not just about 0.1% to about 5%, but also the individual values (e.g., 1%, 2%, 3%, and 4%) and the sub-ranges (e.g., 0.1% to 0.5%, 1.1% to 2.2%, 3.3% to 4.4%) within the indicated range. The statement "about X to Y" has the same meaning as "about X to about Y," unless indicated otherwise. Likewise, the statement "about X, Y, or about Z" has the same meaning as "about X, about Y, or about Z," unless indicated otherwise.

In this document, the terms "a," "an," or "the" are used to include one or more than one unless the context clearly dictates otherwise. The term "or" is used to refer to a nonexclusive "or" unless otherwise indicated. The statement "at least one of A and B" has the same meaning as "A, B, or A and B." In addition, it is to be understood that the phraseology or terminology employed herein, and not otherwise defined, is for the purpose of description only and not of limitation. Any use of section headings is intended to aid reading of the document and is not to be interpreted as limiting; information that is relevant to a section heading may occur within or outside of that particular section.

In the methods described herein, the acts can be carried out in any order without departing from the principles of the disclosure, except when a temporal or operational sequence is explicitly recited. Furthermore, specified acts can be carried out concurrently unless explicit claim language recites that they be carried out separately. For example, a claimed act of doing X and a claimed act of doing Y can be conducted simultaneously within a single operation, and the resulting process will fall within the literal scope of the claimed process.

The term "about" as used herein can allow for a degree of variability in a value or range, for example, within 10%, within 5%, or within 1% of a stated value or of a stated limit of a range, and includes the exact stated value or range.

The term "substantially" as used herein refers to a majority of, or mostly, as in at least about 50%, 60%, 70%, 80%, 90%, 95%, 96%, 97%, 98%, 99%, 99.5%, 99.9%, 99.99%, or at least about 99.999% or more, or 100%.

As used herein "shaped abrasive particle" means an abrasive particle having a predetermined or non-random shape. One process to make a shaped abrasive particle such as a shaped ceramic abrasive particle includes shaping the precursor ceramic abrasive particle in a mold having a predetermined shape to make ceramic shaped abrasive particles. Ceramic shaped abrasive particles, formed in a mold, are one species in the genus of shaped ceramic abrasive particles. Other processes to make other species of shaped ceramic abrasive particles include extruding the precursor ceramic abrasive particle through an orifice having a predetermined shape, printing the precursor ceramic abrasive particle though an opening in a printing screen having a predetermined shape, or embossing the precursor ceramic abrasive particle into a predetermined shape or pattern. In other examples, the shaped ceramic abrasive particles can be cut from a sheet into individual particles. Examples of suitable cutting methods include mechanical cutting, laser cutting, or water-jet cutting. Non-limiting examples of shaped ceramic abrasive particles include shaped abrasive particles, such as triangular plates, or elongated ceramic rods/filaments. Shaped ceramic abrasive particles are generally homogenous or substantially uniform and maintain their sintered shape without the use of a binder such as an organic or inorganic binder that bonds smaller abrasive particles into an agglomerated structure and excludes abrasive particles obtained by a crushing or comminution process that produces abrasive particles of random size and shape. In many embodiments, the shaped ceramic abrasive particles comprise a homogeneous structure of sintered alpha alumina or consist essentially of sintered alpha alumina.

The present application discloses abrasive articles that include shaped abrasive particles, non-shaped abrasive particles or a combination thereof. The abrasive articles can include one or more camouflaging layers that can be uniformly or randomly applied to the abrasive article. The one or more camouflaging or masking layers can minimize or mask any imperfections on the abrasive article in terms of particle placement or voids on the abrasive article where particles are not present, such as a splice. The camouflaging layer can be applied as a discontinuous layer to a portion of a size coat layer of the abrasive article and the discontinuous layer can have a color that is markedly different than a color of the size coat. The discontinuous colored layer can be applied as a repeating pattern on the abrasive article or randomly on the abrasive article. Such design having a discontinuous colored layer can be applicable to abrasive articles in the form of sheets, discs, belts, pads, or rolls. As described further below, such design may provide one or more possible advantages.

Figure 1B:
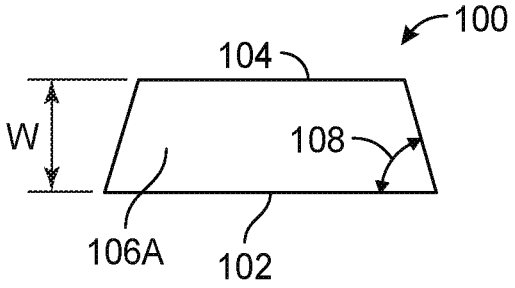

FIGS. 1A and 1B show an example of shaped abrasive particle 100, as an equilateral triangle conforming to a truncated pyramid. As shown in FIGS. 1A and 1B shaped abrasive particle 100 includes a truncated regular triangular pyramid bounded by a triangular base 102, a triangular top 104, and plurality of sloping sides 106A, 106B, 106C connecting triangular base 102 (shown as equilateral although scalene, obtuse, isosceles, and right triangles are possible) and triangular top 104. Slope angle 108A is the dihedral angle formed by the intersection of side 106A with triangular base 102. Similarly, slope angles 108B and 108C (both not shown) correspond to the dihedral angles formed by the respective intersections of sides 106B and 106C with triangular base 102. In the case of shaped abrasive particle 100, all of the slope angles have equal value. In some embodiments, side edges 110A, 110B, and 110C have an average radius of curvature in a range of from about 0.5 μm to about 80 μm, about 10 μm to about 60 μm, or less than, equal to, or greater than about 0.5 μm, 5, 10, 15, 20, 25, 30, 35, 40, 45, 50, 55, 60, 65, 70, 75, or about 80 μm.

In the embodiment shown in FIGS. 1A and 1B, sides 106A, 106B, and 106C have equal dimensions and form dihedral angles with the triangular base 102 of about 82 degrees (corresponding to a slope angle of 82 degrees). However, it will be recognized that other dihedral angles (including 90 degrees) may also be used. For example, the dihedral angle between the base and each of the sides may independently range from 45 to 90 degrees (for example, from 70 to 90 degrees, or from 75 to 85 degrees). Edges connecting sides 106, base 102, and top 104 can have any suitable length. For example, a length of the edges may be in a range of from about 0.5 μm to about 2000 μm, about 150 μm to about 200 μm, or less than, equal to, or greater than about 0.5 μm, 50, 100, 150, 200, 250, 300, 350, 400, 450, 500, 550, 600, 650, 700, 750, 800, 850, 900, 950, 1000, 1050, 1100, 1150, 1200, 1250, 1300, 1350, 1400, 1450, 1500, 1550, 1600, 1650, 1700, 1750, 1800, 1850, 1900, 1950, or about 2000 μm.

As shown in FIG. 1A, shaped abrasive particle 100 can have a length L defined between side edges 110A and 110C of the side 106A, and a height H defined between bottom edge of side 106A and side edge 110B. In an example in which the sides 106 of the particle 100 have differing lengths, the length L can be defined as the longest length among the sides 106. As shown in FIG. 1B, a width W of the particle 100 can be defined between base 102 and top 104. (It is recognized that a height of the particle 100 in the coated position on an abrasive article may be different than its original height H as shown in FIG. 1A (before coating and attachment), depending in part on a placement/orientation of the particle 100 to a backing substrate. Given the volume of particles on the article and a size of the particles, occasional particles can be misplaced or misoriented relative to their intended position/orientation.)

Figure 2A:
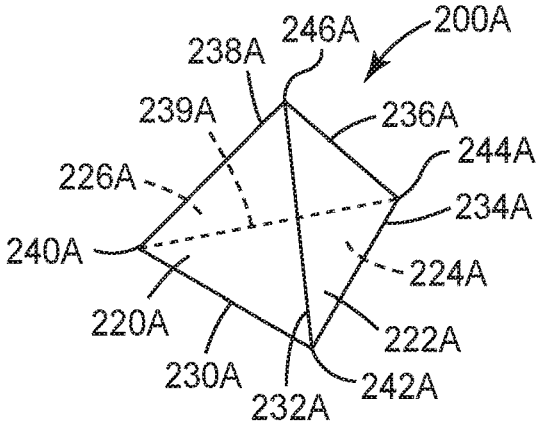
FIGS. 2A-2E are schematic diagrams of shaped abrasive particles having a tetrahedral shape, in accordance with various embodiments.

FIGS. 2A-2E are perspective views of the shaped abrasive particles 200 shaped as tetrahedral abrasive particles. As shown in FIGS. 2A-2E, shaped abrasive particles 200 are shaped as regular tetrahedrons. As shown in FIG. 2A, shaped abrasive particle 200A has four faces (220A, 222A, 224A, and 226A) joined by six edges (230A, 232A, 234A, 236A, 238A, and 239A) terminating at four vertices (240A, 242A, 244A, and 246A). Each of the faces contacts the other three of the faces at the edges. While a regular tetrahedron (e.g., having six equal edges and four faces) is depicted in FIG. 2A, it will be recognized that other shapes are also permissible. For example, tetrahedral abrasive particles 200 can be shaped as irregular tetrahedrons (e.g., having edges of differing lengths). For purposes herein, a length of tetrahedral abrasive particles 200 can be described as the longest length among the differing lengths.

Figure 2B:
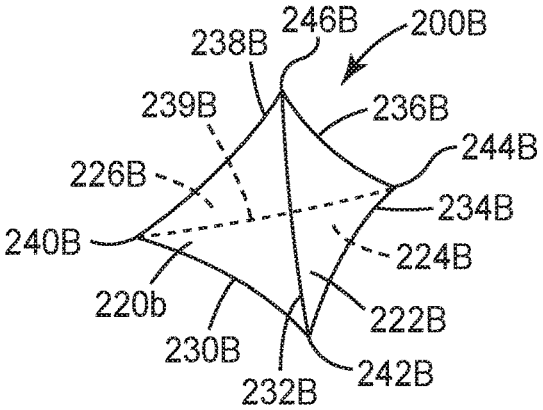

Referring now to FIG. 2B, shaped abrasive particle 200B has four faces (220B, 222B, 224B, and 226B) joined by six edges (230B, 232B, 234B, 236B, 238B, and 239B) terminating at four vertices (240B, 242B, 244B, and 246B). Each of the faces is concave and contacts the other three of the faces at respective common edges. While a particle with tetrahedral symmetry (e.g., four rotational axes of threefold symmetry and six reflective planes of symmetry) is depicted in FIG. 2B, it will be recognized that other shapes are also permissible. For example, shaped abrasive particles 200B can have one, two, or three concave faces with the remainder being planar.

Figure 2C:
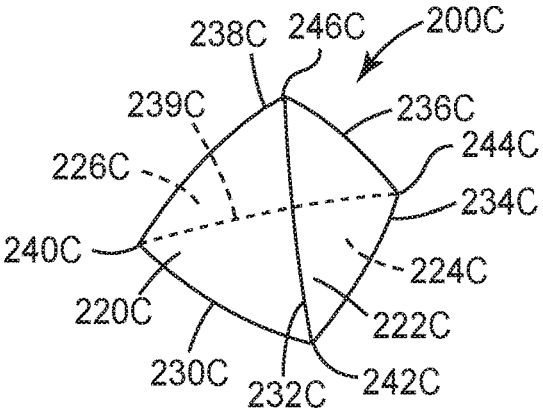

Referring now to FIG. 2C, shaped abrasive particle 200C has four faces (220C, 222C, 224C, and 226C) joined by six edges (230C, 232C, 234C, 236C, 238C, and 239C) terminating at four vertices (240C, 242C, 244C, and 246C). Each of the faces is convex and contacts the other three of the faces at respective common edges. While a particle with tetrahedral symmetry is depicted in FIG. 2C, it will be recognized that other shapes are also permissible. For example, shaped abrasive particles 200C can have one, two, or three convex faces with the remainder being planar or concave.

Figure 2D:
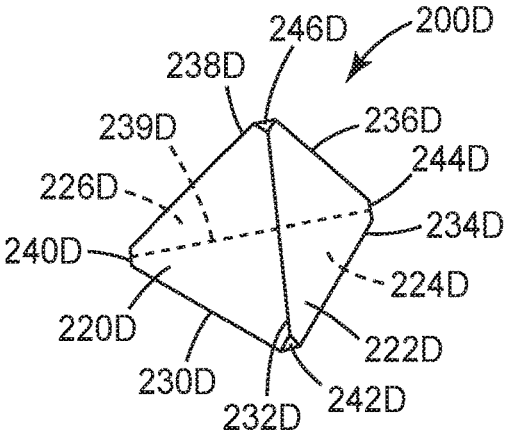

Referring now to FIG. 2D, shaped abrasive particle 200D has four faces (220D, 222D, 224D, and 226D) joined by six edges (230D, 232D, 234D, 236D, 238D, and 239D) terminating at four vertices (240D, 242D, 244D, and 246D). While a particle with tetrahedral symmetry is depicted in FIG. 2D, it will be recognized that other shapes are also permissible. For example, shaped abrasive particles 200D can have one, two, or three convex faces with the remainder being planar.

Figure 2E:
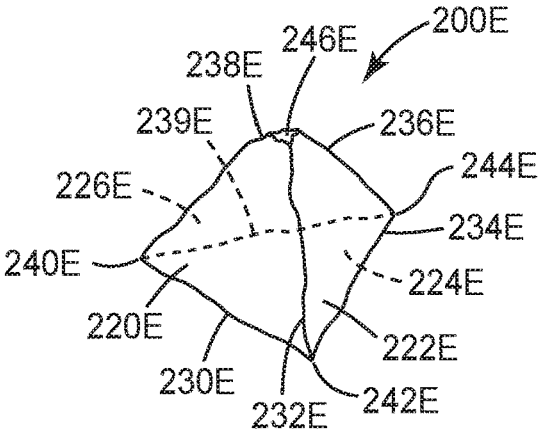

Deviations from the depictions in FIGS. 2A-2D can be present. An example of such a shaped abrasive particle 200 is depicted in FIG. 2E, showing shaped abrasive particle 200E, which has four faces (220E, 222E, 224E, and 226E) joined by six edges (230E, 232E, 234E, 236E, 238E, and 239E) terminating at four vertices (240E, 242E, 244E, and 246E). Each of the faces contacts the other three of the faces at respective common edges. Each of the faces, edges, and vertices has an irregular shape.

In any of shaped abrasive particles 200A-200E, the edges can have the same length or different lengths. The length of any of the edges can be any suitable length. As an example, the length of the edges can be in a range of from about 0.5 μm to about 2000 μm, about 150 μm to about 200 μm, or less than, equal to, or greater than about 0.5 μm, 50, 100, 150, 200, 250, 300, 350, 400, 450, 500, 550, 600, 650, 700, 750, 800, 850, 900, 950, 1000, 1050, 1100, 1150, 1200, 1250, 1300, 1350, 1400, 1450, 1500, 1550, 1600, 1650, 1700, 1750, 1800, 1850, 1900, 1950, or about 2000 μm. shaped abrasive particles 200A-200E can be the same size or different sizes.

Any of shaped abrasive particles 100 or 200 can include any number of shape features. The shape features can help to improve the cutting performance of any of shaped abrasive particles 100 or 200. Examples of suitable shape features include an opening, a concave surface, a convex surface, a groove, a ridge, a fractured surface, a low roundness factor, or a perimeter comprising one or more corner points having a sharp tip. Individual shaped abrasive particles can include any one or more of these features.

In addition to the materials already described, at least one magnetic material may be included within or coated to shaped abrasive particle 100 or 200. Examples of magnetic materials include iron; cobalt; nickel; various alloys of nickel and iron marketed as Permalloy in various grades; various alloys of iron, nickel and cobalt marketed as Fernico, Kovar, FerNiCo I, or FerNiCo II; various alloys of iron, aluminum, nickel, cobalt, and sometimes also copper and/or titanium marketed as Alnico in various grades; alloys of iron, silicon, and aluminum (about 85:9:6 by weight) marketed as Sendust alloy; Heusler alloys (e.g., $Cu_2MnSn$); manganese bismuthide (also known as Bismanol); rare earth magnetizable materials such as gadolinium, dysprosium, holmium, europium oxide, alloys of neodymium, iron and boron (e.g., $Nd_2Fe_{14}B$), and alloys of samanum and cobalt (e.g., $SmCo_5$); MnSb; $MnOFe_2O_3$; $Y_3Fe_5O_{12}$; $CrO_2$; MnAs; ferrites such as ferrite, magnetite; zinc ferrite; nickel ferrite; cobalt ferrite, magnesium ferrite, barium ferrite, and strontium ferrite; yttrium iron garnet; and combinations of the foregoing. In some embodiments, the magnetizable material is an alloy containing 8 to 12 weight percent aluminum, 15 to 26 wt % nickel, 5 to 24 wt % cobalt, up to 6 wt % copper, up to 1% titanium, wherein the balance of material to add up to 100 wt % is iron. In some other embodiments, a magnetizable coating can be deposited on an abrasive particle 100 using a vapor deposition technique such as, for example, physical vapor deposition (PVD) including magnetron sputtering.

Including these magnetizable materials can allow shaped abrasive particle 100 or 200 to be responsive a magnetic field. Any of shaped abrasive particles 100 or 200 can include the same material or include different materials.

Shaped abrasive particle 100 or 200 can be formed in many suitable manners for example, the shaped abrasive particle 100 or 200 can be made according to a multi-operation process. The process can be carried out using any material or precursor dispersion material. Briefly, for embodiments where shaped abrasive particles 100 or 200 are monolithic ceramic particles, the process can include the operations of making either a seeded or non-seeded precursor dispersion that can be converted into a corresponding (e.g., a boehmite sol-gel that can be converted to alpha alumina); filling one or more mold cavities having the desired outer shape of shaped abrasive particle 100 with a precursor dispersion; drying the precursor dispersion to form precursor shaped abrasive particle; removing the precursor shaped abrasive particle 100 from the mold cavities; calcining the precursor shaped abrasive particle 100 to form calcined, precursor shaped abrasive particle 100 or 200; and then sintering the calcined, precursor shaped abrasive particle 100 or 200 to form shaped abrasive particle 100 or 200. The process will now be described in greater detail in the context of alpha-alumina-containing shaped abrasive particle 100 or 200. In other embodiments, the mold cavities may be filled with a melamine to form melamine shaped abrasive particles.

The process can include the operation of providing either a seeded or non-seeded dispersion of a precursor that can be converted into ceramic. In examples where the precursor is seeded, the precursor can be seeded with an oxide of an iron (e.g., FeO). The precursor dispersion can include a liquid that is a volatile component. In one example, the volatile component is water. The dispersion can include a sufficient amount of liquid for the viscosity of the dispersion to be sufficiently low to allow filling mold cavities and replicating the mold surfaces, but not so much liquid as to cause subsequent removal of the liquid from the mold cavity to be prohibitively expensive. In one example, the precursor dispersion includes from 2 percent to 90 percent by weight of the particles that can be converted into ceramic, such as particles of aluminum oxide monohydrate (boehmite), and at least 10 percent by weight, or from 50 percent to 70 percent, or 50 percent to 60 percent, by weight, of the volatile component such as water. Conversely, the precursor dispersion in some embodiments contains from 30 percent to 50 percent, or 40 percent to 50 percent solids by weight.

Examples of suitable precursor dispersions include zirconium oxide sols, vanadium oxide sols, cerium oxide sols, aluminum oxide sols, and combinations thereof. Suitable aluminum oxide dispersions include, for example, boehmite dispersions and other aluminum oxide hydrates dispersions. Boehmite can be prepared by known techniques or can be obtained commercially. Examples of commercially available boehmite include products having the trade designations "DISPERAL" and "DISPAL", both available from Sasol North America, Inc., or "HIQ-40" available from BASF Corporation. These aluminum oxide monohydrates are relatively pure; that is, they include relatively little, if any, hydrate phases other than monohydrates, and have a high surface area.

The physical properties of the resulting shaped abrasive particle 100 or 200 can generally depend upon the type of material used in the precursor dispersion. As used herein, a "gel" is a three-dimensional network of solids dispersed in a liquid.

The precursor dispersion can contain a modifying additive or precursor of a modifying additive. The modifying additive can function to enhance some desirable property of the abrasive particles or increase the effectiveness of the subsequent sintering step. Modifying additives or precursors of modifying additives can be in the form of soluble salts, such as water-soluble salts. They can include a metal-containing compound and can be a precursor of an oxide of magnesium, zinc, iron, silicon, cobalt, nickel, zirconium, hafnium, chromium, yttrium, praseodymium, samarium, ytterbium, neodymium, lanthanum, gadolinium, cerium, dysprosium, erbium, titanium, and mixtures thereof. The particular concentrations of these additives that can be present in the precursor dispersion can be varied.

The introduction of a modifying additive or precursor of a modifying additive can cause the precursor dispersion to gel. The precursor dispersion can also be induced to gel by application of heat over a period of time to reduce the liquid content in the dispersion through evaporation. The precursor dispersion can also contain a nucleating agent. Nucleating agents suitable for this disclosure can include fine particles of alpha alumina, alpha ferric oxide or its precursor, titanium oxides and titanates, chrome oxides, or any other material that will nucleate the transformation. The amount of nucleating agent, if used, should be sufficient to effect the transformation of alpha alumina.

A peptizing agent can be added to the precursor dispersion to produce a more stable hydrosol or colloidal precursor dispersion. Suitable peptizing agents are monoprotic acids or acid compounds such as acetic acid, hydrochloric acid, formic acid, and nitric acid. Multiprotic acids can also be used, but they can rapidly gel the precursor dispersion, making it difficult to handle or to introduce additional components. Some commercial sources of boehmite contain an acid titer (such as absorbed formic or nitric acid) that will assist in forming a stable precursor dispersion.

The precursor dispersion can be formed by any suitable means; for example, in the case of a sol-gel alumina precursor, it can be formed by simply mixing aluminum oxide monohydrate with water containing a peptizing agent or by forming an aluminum oxide monohydrate slurry to which the peptizing agent is added.

Defoamers or other suitable chemicals can be added to reduce the tendency to form bubbles or entrain air while mixing. Additional chemicals such as wetting agents, alcohols, or coupling agents can be added if desired.

A further operation can include providing a mold having at least one mold cavity, or a plurality of cavities formed in at least one major surface of the mold. In some examples, the mold is formed as a production tool, which can be, for example, a belt, a sheet, a continuous web, a coating roll such as a rotogravure roll, a sleeve mounted on a coating roll, or a die. In one example, the production tool can include polymeric material. Examples of suitable polymeric materials include thermoplastics such as polyesters, polycarbonates, poly(ether sulfone), poly(methyl methacrylate), polyurethanes, polyvinylchloride, polyolefin, polystyrene, polypropylene, polyethylene or combinations thereof, or thermosetting materials. In one example, the entire tooling is made from a polymeric or thermoplastic material. In another example, the surfaces of the tooling in contact with the precursor dispersion while the precursor dispersion is drying, such as the surfaces of the plurality of cavities, include polymeric or thermoplastic materials, and other portions of the tooling can be made from other materials. A suitable polymeric coating can be applied to a metal tooling to change its surface tension properties, by way of example.

A polymeric or thermoplastic production tool can be replicated off a metal master tool. The master tool can have the inverse pattern of that desired for the production tool. The master tool can be made in the same manner as the production tool. In one example, the master tool is made out of metal (e.g., nickel) and is diamond-turned. In one example, the master tool is at least partially formed using stereolithography. The polymeric sheet material can be heated along with the master tool such that the polymeric material is embossed with the master tool pattern by pressing the two together. A polymeric or thermoplastic material can also be extruded or cast onto the master tool and then pressed. The thermoplastic material is cooled to solidify and produce the production tool. If a thermoplastic production tool is utilized, then care should be taken not to generate excessive heat that can distort the thermoplastic production tool, limiting its life.

Access to cavities can be from an opening in the top surface or bottom surface of the mold. In some examples, the cavities can extend for the entire thickness of the mold. Alternatively, the cavities can extend only for a portion of the thickness of the mold. In one example, the top surface is substantially parallel to the bottom surface of the mold with the cavities having a substantially uniform depth. At least one side of the mold, the side in which the cavities are formed, can remain exposed to the surrounding atmosphere during the step in which the volatile component is removed.

The cavities have a specified three-dimensional shape to make shaped abrasive particle 100. The depth dimension is equal to the perpendicular distance from the top surface to the lowermost point on the bottom surface. The depth of a given cavity can be uniform or can vary along its length and/or width. The cavities of a given mold can be of the same shape or of different shapes.

A further operation involves filling the cavities in the mold with the precursor dispersion (e.g., by a conventional technique). In some examples, a knife roll coater or vacuum slot die coater can be used. A mold release agent can be used to aid in removing the particles from the mold if desired. Examples of mold release agents include oils such as peanut oil or mineral oil, fish oil, silicones, polytetrafluoroethylene, zinc stearate, and graphite. In general, a mold release agent such as peanut oil, in a liquid, such as water or alcohol, is applied to the surfaces of the production tooling in contact with the precursor dispersion such that from about 0.1 $mg/in^2$ (0.6 $mg/cm^2$) to about 3.0 $mg/in^2$ (20 $mg/cm^2$), or from about 0.1 $mg/in^2$ (0.6 $mg/cm^2$) to about 5.0 $mg/in^2$ (30 $mg/cm^2$), of the mold release agent is present per unit area of the mold when a mold release is desired. In some embodiments, the top surface of the mold is coated with the precursor dispersion. The precursor dispersion can be pumped onto the top surface.

In a further operation, a scraper or leveler bar can be used to force the precursor dispersion fully into the cavity of the mold. The remaining portion of the precursor dispersion that does not enter the cavity can be removed from the top surface of the mold and recycled. In some examples, a small portion of the precursor dispersion can remain on the top surface, and in other examples the top surface is substantially free of the dispersion. The pressure applied by the scraper or leveler bar can be less than 100 psi (0.6 MPa), or less than 50 psi (0.3 MPa), or even less than 10 psi (60 kPa). In some examples, no exposed surface of the precursor dispersion extends substantially beyond the top surface.

In those examples where it is desired to have the exposed surfaces of the cavities result in planar faces of the shaped abrasive particles, it can be desirable to overfill the cavities (e.g., using a micronozzle array) and slowly dry the precursor dispersion.

A further operation involves removing the volatile component to dry the dispersion. The volatile component can be removed by fast evaporation rates. In some examples, removal of the volatile component by evaporation occurs at temperatures above the boiling point of the volatile component. An upper limit to the drying temperature often depends on the material the mold is made from. For polypropylene tooling, the temperature should be less than the melting point of the plastic. In one example, for a water dispersion of from about 40 to 50 percent solids and a polypropylene mold, the drying temperatures can be from about 90° C. to about 165° C., or from about 105° C. to about 150° C., or from about 105° C. to about 120° C. Higher temperatures can lead to improved production speeds but can also lead to degradation of the polypropylene tooling, limiting its useful life as a mold.

During drying, the precursor dispersion shrinks, often causing retraction from the cavity walls. For example, if the cavities have planar walls, then the resulting shaped abrasive particle 100 can tend to have at least three concave major sides. It is presently discovered that by making the cavity walls concave (whereby the cavity volume is increased) it is possible to obtain shaped abrasive particle 100 that have at least three substantially planar major sides. The degree of concavity generally depends on the solids content of the precursor dispersion.

A further operation involves removing resultant precursor shaped abrasive particle 100 from the mold cavities. The precursor shaped abrasive particle 100 or 200 can be removed from the cavities by using the following processes alone or in combination on the mold: gravity, vibration, ultrasonic vibration, vacuum, or pressurized air to remove the particles from the mold cavities.

The precursor shaped abrasive particle 100 or 200 can be further dried outside of the mold. If the precursor dispersion is dried to the desired level in the mold, this additional drying step is not necessary. However, in some instances it can be economical to employ this additional drying step to minimize the time that the precursor dispersion resides in the mold. The precursor shaped abrasive particle 100 or 200 will be dried from 10 to 480 minutes, or from 120 to 400 minutes, at a temperature from 50° C. to 160° C., or 120° C. to 150° C.

A further operation involves calcining the precursor shaped abrasive particle 100 or 200. During calcining, essentially all the volatile material is removed, and the various components that were present in the precursor dispersion are transformed into metal oxides. The precursor shaped abrasive particle 100 or 200 is generally heated to a temperature from 400° C. to 800° C. and maintained within this temperature range until the free water and over 90 percent by weight of any bound volatile material are removed. In an optional step, it can be desirable to introduce the modifying additive by an impregnation process. A water-soluble salt can be introduced by impregnation into the pores of the calcined, precursor shaped abrasive particle 100. Then the precursor shaped abrasive particle 100 are pre-fired again.

A further operation can involve sintering the calcined, precursor shaped abrasive particle 100 or 200 to form particles 100 or 200. In some examples where the precursor includes rare earth metals, however, sintering may not be necessary. Prior to sintering, the calcined, precursor shaped abrasive particle 100 or 200 are not completely densified and thus lack the desired hardness to be used as shaped abrasive particle 100 or 200. Sintering takes place by heating the calcined, precursor shaped abrasive particle 100 or 200 to a temperature of from 1000° C. to 1650° C. The length of time for which the calcined, precursor shaped abrasive particle 100 or 200 can be exposed to the sintering temperature to achieve this level of conversion depends upon various factors, but from five seconds to 48 hours is possible.

In another embodiment, the duration of the sintering step ranges from one minute to 90 minutes. After sintering, the shaped abrasive particle 14 can have a Vickers hardness of 10 GPa (gigaPascals), 16 GPa, 18 GPa, 20 GPa, or greater.

Additional operations can be used to modify the described process, such as, for example, rapidly heating the material from the calcining temperature to the sintering temperature, and centrifuging the precursor dispersion to remove sludge and/or waste. Moreover, the process can be modified by combining two or more of the process steps if desired.

Figure 3A:
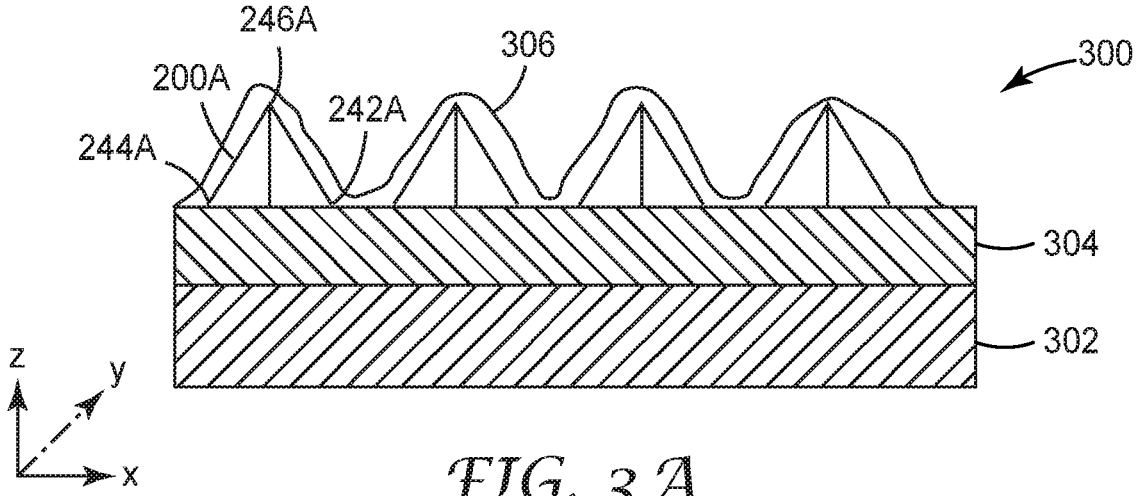
FIGS. 3A and 3B are sectional views of coated abrasive articles, in accordance with various embodiments.

FIG. 3A is a sectional view of coated abrasive article 300. Coated abrasive article 300 includes backing 302 defining a surface along an x-y direction. Backing 302 has a first layer of binder, hereinafter referred to as make coat 304, applied over a first surface of backing 302. Attached or partially embedded in make coat 304 are a plurality of shaped abrasive particles 200A. Although shaped abrasive particles 200A are shown any other shaped abrasive particle described herein can be included in coated abrasive article 300. An optional second layer of binder, hereinafter referred to as size coat 306, is dispersed over shaped abrasive particles 200A. As shown, a major portion of shaped abrasive particles 200A have at least one of three vertices (240, 242, and 244) oriented in substantially the same direction. Thus, shaped abrasive particles 200A are oriented according to a non-random distribution, although in other embodiments any of shaped abrasive particles 200A can be randomly oriented on backing 302. In some embodiments, control of a particle's orientation can increase the cut of the abrasive article.

Backing 302 can be flexible or rigid. Examples of suitable materials for forming a flexible backing include a polymeric film, a metal foil, a woven fabric, a knitted fabric, paper, vulcanized fiber, a staple fiber, a continuous fiber, a nonwoven, a foam, a screen, a laminate, and combinations thereof. Backing 302 can be shaped to allow coated abrasive article 300 to be in the form of sheets, discs, belts, pads, or rolls. In some embodiments, backing 302 can be sufficiently flexible to allow coated abrasive article 300 to be formed into a loop to make an abrasive belt that can be run on suitable grinding equipment.

Make coat 304 secures shaped abrasive particles 200A to backing 302, and size coat 306 can help to reinforce shaped abrasive particles 200A. Make coat 304 and/or size coat 306 can include a resinous adhesive. The resinous adhesive can include one or more resins chosen from a phenolic resin, an epoxy resin, a urea-formaldehyde resin, an acrylate resin, an aminoplast resin, a melamine resin, an acrylated epoxy resin, a urethane resin, a polyester resin, a dying oil, and mixtures thereof.

Figure 3B:
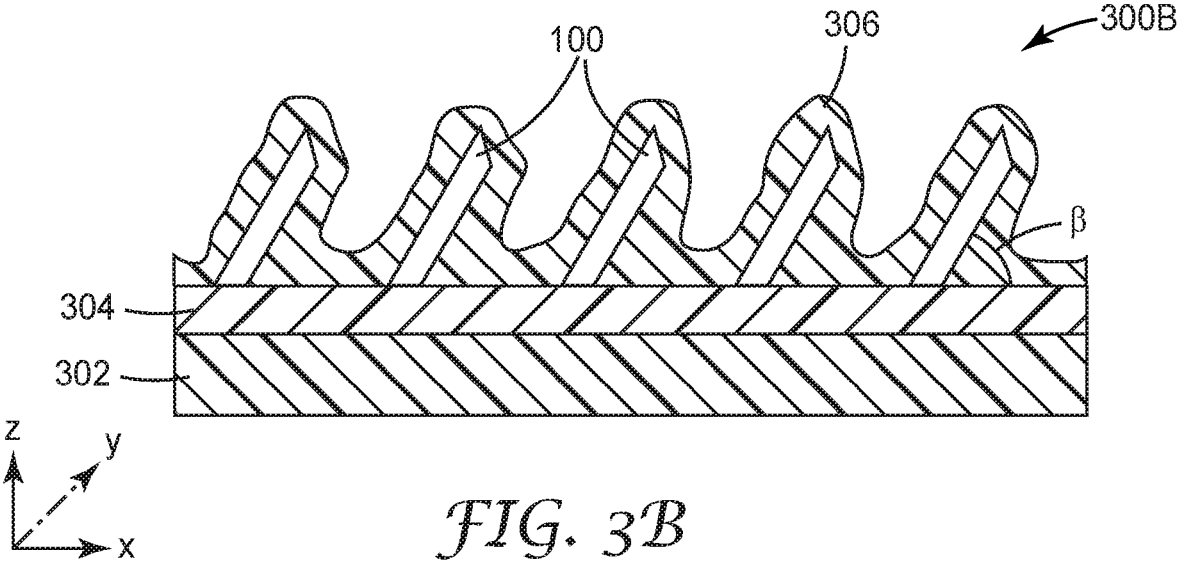

FIG. 3B shows an example of coated abrasive article 300B, which includes shaped abrasive particles 100 instead of shaped abrasive particles 200. As shown, shaped abrasive particles 100 are attached to backing 302 by make coat 304 with size coat 306 applied to further attach or adhere shaped abrasive particles 100 to the backing 302. As shown in FIG. 3B, the majority of the shaped abrasive particles 100 are tipped or leaning to one side. This results in the majority of shaped abrasive particles 100 having an orientation angle θ less than 90 degrees relative to backing 302.

Abrasive article 300 can also include conventional (e.g., crushed) abrasive particles. Examples of useful abrasive particles include fused aluminum oxide-based materials such as aluminum oxide, ceramic aluminum oxide (which can include one or more metal oxide modifiers and/or seeding or nucleating agents), and heat-treated aluminum oxide, silicon carbide, co-fused alumina-zirconia, diamond, ceria, titanium diboride, cubic boron nitride, boron carbide, garnet, flint, emery, sol-gel derived abrasive particles, and mixtures thereof.

The conventional abrasive particles can, for example, have an average diameter ranging from about 10 μm to about 2000 μm, about 20 μm to about 1300 μm, about 50 μm to about 1000 μm, less than, equal to, or greater than about 10 μm, 20, 30, 40, 50, 100, 150, 200, 250, 300, 350, 400, 450, 500, 550, 600, 650, 700, 750, 800, 850, 900, 950, 1000, 1050, 1100, 1150, 1200, 1250, 1300, 1350, 1400, 1450, 1500, 1550, 1650, 1700, 1750, 1800, 1850, 1900, 1950, or 2000 μm. For example, the conventional abrasive particles can have an abrasives industry-specified nominal grade. Such abrasives industry-accepted grading standards include those known as the American National Standards Institute, Inc. (ANSI) standards, Federation of European Producers of Abrasive Products (FEPA) standards, and Japanese Industrial Standard (HS) standards. Exemplary ANSI grade designations (e.g., specified nominal grades) include: ANSI 12 (1842 μm), ANSI 16 (1320 μm), ANSI 20 (905 μm), ANSI 24 (728 μm), ANSI 36 (530 μm), ANSI 40 (420 μm), ANSI 50 (351 μm), ANSI 60 (264 μm), ANSI 80 (195 μm), ANSI 100 (141 μm), ANSI 120 (116 μm), ANSI 150 (93 μm), ANSI 180 (78 μm), ANSI 220 (66 μm), ANSI 240 (53 μm), ANSI 280 (44 μm), ANSI 320 (46 μm), ANSI 360 (30 μm), ANSI 400 (24 μm), and ANSI 600 (16 μm). Exemplary FEPA grade designations include P12 (1746 μm), P16 (1320 μm), P20 (984 μm), P24 (728 μm), P30 (630 μm), P36 (530 μm), P40 (420 μm), P50 (326 μm), P60 (264 μm), P80 (195 μm), P100 (156 μm), P120 (127 μm), P120 (127 μm), P150 (97 μm), P180 (78 μm), P220 (66 μm), P240 (60 μm), P280 (53 μm), P320 (46 μm), P360 (41 μm), P400 (36 μm), P500 (30 μm), P600 (26 μm), and P800 (22 μm). An approximate average particles size of reach grade is listed in parenthesis following each grade designation.

Shaped abrasive particles 100 or 200 or crushed abrasive particles can include any suitable material or mixture of materials. For example, shaped abrasive particles 100 can include a material chosen from an alpha-alumina, a fused aluminum oxide, a heat-treated aluminum oxide, a ceramic aluminum oxide, a sintered aluminum oxide, a silicon carbide, a titanium diboride, a boron carbide, a tungsten carbide, a titanium carbide, a diamond, a cubic boron nitride, a garnet, a fused alumina-zirconia, a sol-gel derived abrasive particle, a cerium oxide, a zirconium oxide, a titanium oxide, and combinations thereof. In some embodiments, shaped abrasive particles 100 or 200 and crushed abrasive particles can include the same materials. In further embodiments, shaped abrasive particles 100 or 200 and crushed abrasive particles can include different materials.

Filler particles can also be included in abrasive articles 200 or 300. Examples of useful fillers include metal carbonates (such as calcium carbonate, calcium magnesium carbonate, sodium carbonate, magnesium carbonate), silica (such as quartz, glass beads, glass bubbles and glass fibers), silicates (such as talc, clays, montmorillonite, feldspar, mica, calcium silicate, calcium metasilicate, sodium aluminosilicate, sodium silicate), metal sulfates (such as calcium sulfate, barium sulfate, sodium sulfate, aluminum sodium sulfate, aluminum sulfate), gypsum, vermiculite, sugar, wood flour, a hydrated aluminum compound, carbon black, metal oxides (such as calcium oxide, aluminum oxide, tin oxide, titanium dioxide), metal sulfites (such as calcium sulfite), thermoplastic particles (such as polycarbonate, polyetherimide, polyester, polyethylene, poly(vinylchloride), polysulfone, polystyrene, acrylonitrile-butadiene-styrene block copolymer, polypropylene, acetal polymers, polyurethanes, nylon particles) and thermosetting particles (such as phenolic bubbles, phenolic beads, polyurethane foam particles and the like). The filler may also be a salt such as a halide salt. Examples of halide salts include sodium chloride, potassium cryolite, sodium cryolite, ammonium cryolite, potassium tetrafluoroborate, sodium tetrafluoroborate, silicon fluorides, potassium chloride, magnesium chloride. Examples of metal fillers include, tin, lead, bismuth, cobalt, antimony, cadmium, iron and titanium. Other miscellaneous fillers include sulfur, organic sulfur compounds, graphite, lithium stearate and metallic sulfides. In some embodiments, individual shaped abrasive particles 100 or individual crushed abrasive particles can be at least partially coated with an amorphous, ceramic, or organic coating. Examples of suitable components of the coatings include, a silane, glass, iron oxide, aluminum oxide, or combinations thereof. Coatings such as these can aid in processability and bonding of the particles to a resin of a binder.

Some shaped abrasive particles 100 or 200 can include a polymeric material and can be characterized as soft abrasive particles. The soft shaped abrasive particles described herein can independently include any suitable material or combination of materials. For example, the soft shaped abrasive particles can include a reaction product of a polymerizable mixture including one or more polymerizable resins. The one or more polymerizable resins such as a hydrocarbyl polymerizable resin. Examples of such resins include those chosen from a phenolic resin, a urea formaldehyde resin, a urethane resin, a melamine resin, an epoxy resin, a bismaleimide resin, a vinyl ether resin, an aminoplast resin (which may include pendant alpha, beta unsaturated carbonyl groups), an acrylate resin, an acrylated isocyanurate resin, an isocyanurate resin, an acrylated urethane resin, an acrylated epoxy resin, an alkyl resin, a polyester resin, a drying oil, or mixtures thereof. The polymerizable mixture can include additional components such as a plasticizer, an acid catalyst, a cross-linker, a surfactant, a mild-abrasive, a pigment, a catalyst and an antibacterial agent.

Where multiple components are present in the polymerizable mixture, those components can account for any suitable weight percentage of the mixture. For example, the polymerizable resin or resins, may be in a range of from about 35 wt % to about 99.9 wt % of the polymerizable mixture, about 40 wt % to about 95 wt %, or less than, equal to, or greater than about 35 wt %, 40, 41, 42, 43, 44, 45, 46, 47, 48, 49, 50, 51, 52, 53, 54, 55, 56, 57, 58, 59, 60, 61, 62, 63, 64, 65, 66, 67, 68, 69, 70, 71, 72, 73, 74, 75, 76, 77, 78, 79, 80, 81, 82, 83, 84, 85, 86, 87, 88, 89, 90, 91, 92, 93, 94, 95, 96, 97, 98, or about 99.9 wt %.

If present, the cross-linker may be in a range of from about 2 wt % to about 60 wt % of the polymerizable mixture, from about 5 wt % to about 10 wt %, or less than, equal to, or greater than about 2 wt %, 3, 4, 5, 6, 7, 8, 9, 10, 11, 12, 13, 14, or about 15 wt %. Examples of suitable cross-linkers include a cross-linker available under the trade designation CYMEL 303 LF, of Allnex USA Inc., Alpharetta, Georgia, USA; or a cross-linker available under the trade designation CYMEL 385, of Allnex USA Inc., Alpharetta, Georgia, USA.

If present, the mild-abrasive may be in a range of from about 5 wt % to about 65 wt % of the polymerizable mixture, about 10 wt % to about 20 wt %, or less than, equal to, or greater than about 5 wt %, 6, 7, 8, 9, 10, 11, 12, 13, 14, 15, 16, 17, 18, 19, 20, 21, 22, 23, 24, 25, 26, 27, 28, 29, 30, 31, 32, 33, 34, 35, 36, 37, 38, 39, 40, 41, 42, 43, 44, 45, 46, 47, 48, 49, 50, 51, 52, 53, 54, 55, 56, 57, 58, 59, 60, 61, 62, 63, 64, or about 65 wt %. Examples of suitable mild-abrasives include a mild-abrasive available under the trade designation MINSTRON 353 TALC, of Imerys Talc America, Inc., Three Forks, Montana, USA; a mild-abrasive available under the trade designation USG TERRA ALBA NO. 1 CALCIUM SULFATE, of USG Corporation, Chicago, Illinois, USA; Recycled Glass (40-70 Grit) available from ESCA Industries, Ltd., Hatfield, Pennsylvania, USA, silica, calcite, nepheline, syenite, calcium carbonate, or mixtures thereof.

If present, the plasticizer may be in a range of from about 5 wt % to about 40 wt % of the polymerizable mixture, about 10 wt % to about 15 wt %, or less than, equal to, or greater than about 5 wt %, 6, 7, 8, 9, 10, 11, 12, 13, 14, 15, 16, 17, 18, 19, 20, 21, 22, 23, 24, 25, 26, 27, 28, 29, 30, 31, 32, 33, 34, 35, 36, 37, 38, 39, or about 40 wt %. Examples of suitable plasticizers include acrylic resins or styrene butadiene resins. Examples of acrylic resins include an acrylic resin available under the trade designation RHOPLEX GL-618, of DOW Chemical Company, Midland, Michigan, USA; an acrylic resin available under the trade designation HYCAR 2679, of the Lubrizol Corporation, Wickliffe, Ohio, USA; an acrylic resin available under the trade designation HYCAR 26796, of the Lubrizol Corporation, Wickliffe, Ohio, USA; a polyether polyol available under the trade designation ARCOL LG-650, of DOW Chemical Company, Midland, Michigan, USA; or an acrylic resin available under the trade designation HYCAR 26315, of the Lubrizol Corporation, Wickliffe, Ohio, USA. An example of a styrene butadiene resin includes a resin available under the trade designation ROVENE 5900, of Mallard Creek Polymers, Inc., Charlotte, North Carolina, USA.

If present, the acid catalyst may be in a range of from 0.5 wt % to about 20 wt % of the polymerizable mixture, about 5 wt % to about 10 wt %, or less than, equal to, or greater than about 1 wt %, 2, 3, 4, 5, 6, 7, 8, 9, 10, 11, 12, 13, 14, 15, 16, 17, 18, 19, or about 20 wt %. Examples of suitable acid catalysts include a solution of aluminum chloride or a solution of ammonium chloride.

If present, the surfactant can be in a range of from about 0.001 wt % to about 15 wt % of the polymerizable mixture about 5 wt % to about 10 wt %, less than, equal to, or greater than about 0.001 wt %, 0.01, 0.5, 1, 2, 3, 4, 5, 6, 7, 8, 9, 10, 11, 12, 13, 14, or about 15 wt %. Examples of suitable surfactants include a surfactant available under the trade designation GEMTEX SC-85-P, of Innospec Performance Chemicals, Salisbury, North Carolina, USA; a surfactant available under the trade designation DYNOL 604, of Air Products and Chemicals, Inc., Allentown, Pennsylvania, USA; a surfactant available under the trade designation ACRYSOL RM-8W, of DOW Chemical Company, Midland, Michigan, USA; or a surfactant available under the trade designation XIAMETER AFE 1520, of DOW Chemical Company, Midland, Michigan, USA.

If present, the antimicrobial agent may be in a range of from 0.5 wt % to about 20 wt % of the polymerizable mixture, about 10 wt % to about 15 wt %, or less than, equal to, or greater than about 0.5 wt %, 1, 2, 3, 4, 5, 6, 7, 8, 9, 10, 11, 12, 13, 14, 15, 16, 17, 18, 19, or about 20 wt %. An example of a suitable antimicrobial agent includes zinc pyrithione.

If present, the pigment may be in a range of from about 0.1 wt % to about 10 wt % of the polymerizable mixture, about 3 wt % to about 5 wt %, less than, equal to, or greater than about 0.1 wt %, 0.2, 0.4, 0.6, 0.8, 1, 1.5, 2, 2.5, 3, 3.5, 4, 4.5, 5, 5.5, 6, 6.5, 7, 7.5, 8, 8.5, 9, 9.5, or about 10 wt %. Examples of suitable pigments include a pigment dispersion available under the trade designation SUNSPERSE BLUE 15, of Sun Chemical Corporation, Parsippany, New Jersey, USA; a pigment dispersion available under the trade designation SUNSPERSE VIOLET 23, of Sun Chemical Corporation, Parsippany, New Jersey, USA; a pigment dispersion available under the trade designation SUN BLACK, of Sun Chemical Corporation, Parsippany, New Jersey, USA; or a pigment dispersion available under the trade designation BLUE PIGMENT B2G, of Clariant Ltd., Charlotte, North Carolina, USA. The mixture of components can be polymerized by curing.

As shown in FIGS. 3A and 3B each of the plurality of shaped abrasive particles 100 or 200 can have a specified z-direction rotational orientation about a z-axis passing through shaped abrasive particles 100 or 200 and through backing 302 at a 90 degree angle to backing 302. Shaped abrasive particles 100 or 200 are orientated with a surface feature, such as a substantially planar surface particle 100 or 200, rotated into a specified angular position about the z-axis. The specified z-direction rotational orientation abrasive article 300A or 300B occurs more frequently than would occur by a random z-directional rotational orientation of the surface feature due to electrostatic coating or drop coating of the shaped abrasive particles 100 or 200 when forming the abrasive article 300A or 300B. As such, by controlling the z-direction rotational orientation of a significantly large number of shaped abrasive particles 100 or 200, the cut rate, finish, or both of coated abrasive article 300A or 300B can be varied from those manufactured using an electrostatic coating method. In various embodiments, at least 50, 51, 55, 60, 65, 70, 75, 80, 85, 90, 95, or 99 percent of shaped abrasive particles 100 or 200 can have a specified z-direction rotational orientation which does not occur randomly and which can be substantially the same for all of the aligned particles. In other embodiments, about 50 percent of shaped abrasive particles 100 or 200 can be aligned in a first direction and about 50 percent of shaped abrasive particles 100 or 200 can be aligned in a second direction. In one embodiment, the first direction is substantially orthogonal to the second direction.

The specific z-direction rotational orientation of formed abrasive particles can be achieved through use of a precision apertured screen that positions shaped abrasive particles 100 or 200 into a specific z-direction rotational orientation such that shaped abrasive particle 100 or 200 can only fit into the precision apertured screen in a few specific orientations such as less than or equal to 4, 3, 2, or 1 orientations. For example, a rectangular opening just slightly bigger than the cross section of shaped abrasive particle 100 or 200 comprising a rectangular plate will orient shaped abrasive particle 100 or 200 in one of two possible 180 degree opposed z-direction rotational orientations. The precision apertured screen can be designed such that shaped abrasive particles 100 or 200, while positioned in the screen's apertures, can rotate about their z-axis (normal to the screen's surface when the formed abrasive particles are positioned in the aperture) less than or equal to about 30, 20, 10, 5, 2, or 1 angular degrees.

The precision apertured screen having a plurality of apertures selected to z-directionally orient shaped abrasive particles 100 and 200 into a pattern, can have a retaining member such as adhesive tape on a second precision apertured screen with a matching aperture pattern, an electrostatic field used to hold the particles in the first precision screen or a mechanical lock such as two precision apertured screens with matching aperture patterns twisted in opposite directions to pinch particles 100 and 200 within the apertures. The first precision aperture screen is filled with shaped abrasive particles 100 and 200, and the retaining member is used to hold shaped abrasive particles 100 in place in the apertures. In one embodiment, adhesive tape on the surface of a second precision aperture screen aligned in a stack with the first precision aperture screen causes shaped abrasive particles 100 to stay in the apertures of the first precision screen stuck to the surface of the tape exposed in the second precision aperture screen's apertures.

Following positioning in apertures, coated backing 302 having make layer 304 is positioned parallel to the first precision aperture screen surface containing the shaped abrasive particles 100 or 200 with make layer 304 facing shaped abrasive particles 100 or 200 in the apertures. Thereafter, coated backing 302 and the first precision aperture screen are brought into contact to adhere shaped abrasive particles 100 or 200 to the make layer. The retaining member is released such as removing the second precision aperture screen with taped surface, untwisting the two precision aperture screens, or eliminating the electrostatic field. Then the first precision aperture screen is then removed leaving the shaped abrasive particles 100 or 200 having a specified z-directional rotational orientation on the coated abrasive article 300 for further conventional processing such as applying a size coat and curing the make and size coats.

In the case of a coated abrasive article, the curable binder precursor comprises a make layer precursor, and the magnetizable particles comprise magnetizable abrasive particles. A size layer precursor may be applied over the at least partially cured make layer precursor and the magnetizable abrasive particles, although this is not a requirement. If present, the size layer precursor is then at least partially cured at a second curing station, optionally with further curing of the at least partially cured make layer precursor. In some embodiments, a supersize layer is disposed on the at least partially cured size layer precursor.

Figure 4:
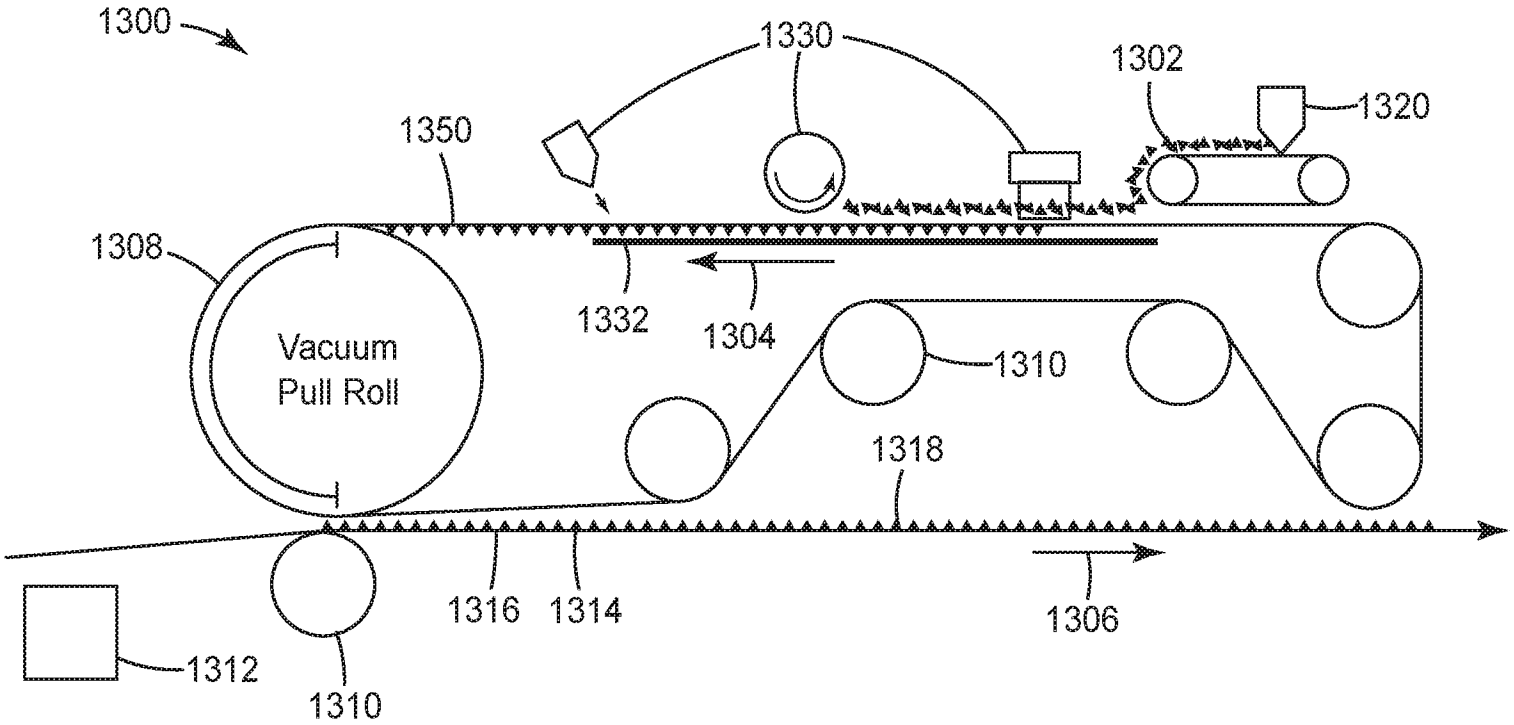
FIG. 4 is a schematic diagram showing a system for manufacturing abrasive articles in accordance with various embodiments.
Figure 5:
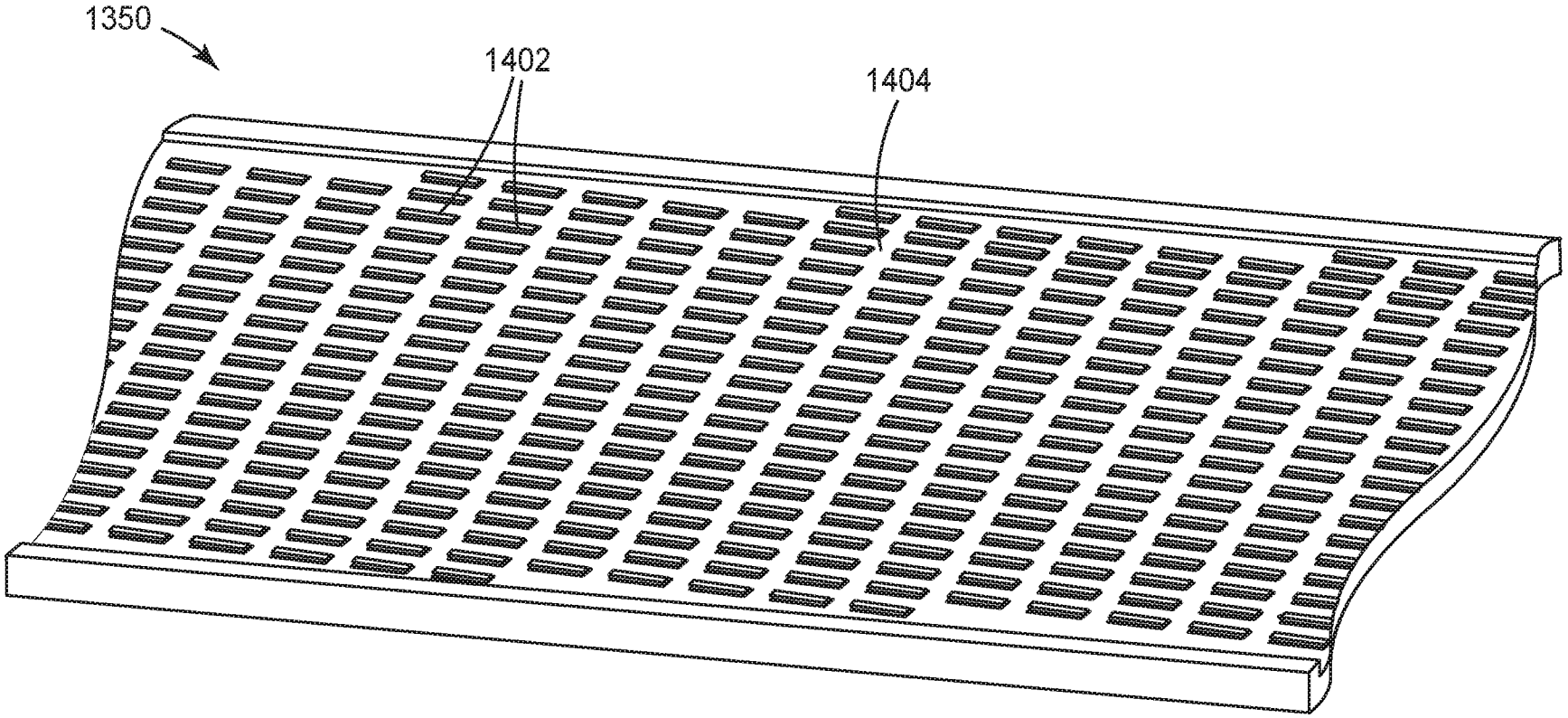
FIG. 5 is a section of tooling from the system of FIG. 13 in accordance with various embodiments.

Another tool and method to form abrasive article 300 in which shaped abrasive particles 100 or 200 have a specified z-direction rotational angle is to use the system shown in FIGS. 4 and 5. In FIGS. 4 and 5, coated abrasive article system 1300 according to the present disclosure includes shaped abrasive particles 1302 removably disposed within cavities 1402 ofproduction tool 1350 having first web path 1304 guiding production tool 1350 through system 1300 such that it wraps a portion of an outer circumference of shaped abrasive particle transfer roll 1308. System 1300 can include, for example, idler rollers 1310 and make coat delivery system 1312. These components unwind backing 1314, deliver make coat resin 1316 via make coat delivery system 1312 to a make coat applicator and apply make coat resin to first major surface 1318 of backing 1314. Thereafter resin coated backing 1314 is positioned by an idler roll 1310 for application of shaped abrasive particles 1302 to the first major surface 1318 coated with make coat resin 1316. Second web path 1306 for resin coated backing 1314 passes through the system 1300 such that the resin layer is positioned facing a dispensing surface 1404 (FIG. 5) of production tool 1350 that is positioned between resin coated backing 1314 and an outer circumference of the shaped abrasive particle transfer roll 1308. Suitable unwinds, make coat delivery systems, make coat resins, coaters and backings are known to those of skill in the art. Make coat delivery system 1312 can be a simple pan or reservoir containing the make coat resin or a pumping system with a storage tank and delivery plumbing to translate make coat resin 1316 to a needed location. Backing 1314 can be a cloth, paper, film, nonwoven, scrim, or other web substrate. Make coat applicator 1312 can be, for example, a coater, a roll coater, a spray system, a die coater, or a rod coater. Alternatively, a precoated coated backing can be positioned by an idler roll 1310 for application of shaped abrasive particles 1302 to the first major surface.

As shown in FIG. 5, production tool 1350 comprises a plurality of cavities 1402 having a complimentary shape to intended shaped abrasive particle 1302 to be contained therein. Shaped abrasive particle feeder 1320 supplies at least some shaped abrasive particles 1302 to production tool 1350. Shaped abrasive particle feeder 1320 can supply an excess of shaped abrasive particles 1302 such that there are more shaped abrasive particles 1302 present per unit length of production tool in the machine direction than cavities 1402 present. Supplying an excess of shaped abrasive particles 1302 helps to ensure that a desired number of cavities 1402 within the production tool 1350 are eventually filled with shaped abrasive particle 1302. Since the bearing area and spacing of shaped abrasive particles 1302 is often designed into production tooling 1350 for the specific grinding application it is desirable to not have too many unfilled cavities 1402. Shaped abrasive particle feeder 1320 can be the same width as the production tool 1350 and can supply shaped abrasive particles 1302 across the entire width of production tool 1350, Shaped abrasive particle feeder 1320 can be, for example, a vibratory feeder, a hopper, a chute, a silo, a drop coater, or a screw, feeder.

Optionally, filling assist system 1330 is provided after shaped abrasive particle feeder 1320 to move shaped abrasive particles 1302 around on the surface of production tool 1350 and to help orientate or slide shaped abrasive particles 1302 into the cavities 1402. Filling assist system 1330 can be, for example, a doctor blade, a felt wiper, a brush having a plurality of bristles, a vibration system, a blower or air knife, a vacuum box, or combinations thereof. Filling assist system 1330 moves, translates, sucks, or agitates shaped abrasive particles 1302 on dispensing surface 1404 (top or upper surface of production tool 1350 in FIG. 4) to place more shaped abrasive particles 1302 into cavities 1402. Without filling assist system 1330, generally at least some of shaped abrasive particles 1302 dropped onto dispensing surface 1404 will fall directly into cavities 1402 and no further movement is required but others may need some additional movement to be directed into cavities 1402. Optionally, filling assist system 1330 can be oscillated laterally in the cross direction or otherwise have a relative motion such as circular or oval to the surface of production tool 1350 using a suitable drive to assist in completely filling each cavity 1402 in production tool 1350 with a shaped abrasive particle 1302. If a brush is included as a component of the filling assist system 1330, the bristles may cover a section of dispensing surface 1404 from 2-60 inches (5.0-153 cm) in length in the machine direction across all or most all of the width of dispensing surface 1404, and lightly rest on or just above dispensing surface 1404, and be of a moderate flexibility. Vacuum box 1332, if included in the filling assist system 1330, can be in conjunction with production tool 1350 having cavities 1402 extending completely through production tool 1350. Vacuum box may be located near shaped abrasive particle feeder 1320 and may be located before or after shaped abrasive particle feeder 1320, or encompass any portion of a web span between a pair of idler rolls 1310 in the shaped abrasive particle filling and excess removal section of the apparatus. Alternatively, production tool 1350 can be supported or pushed on by a shoe or a plate to assist in keeping it planar in this section of the apparatus instead or in addition to vacuum box 1332. As shown in FIG. 4, it is possible to include one or more components in system 1330 to remove excess shaped abrasive particles 1302, in some embodiments it may be possible to include only one component in system 1330.

After leaving the shaped abrasive particle filling and excess removal section of system 1300, shaped abrasive particles 1302 in production tool 1350 travel towards resin coated backing 1314. Shaped abrasive particle transfer roll 1308 is provided and production tooling 1350 can wrap at least a portion of the roll's circumference. In some embodiments, Production tool 1350 wraps between 30 to 180 degrees or between 90 to 180 degrees of the outer circumference of shaped abrasive particle transfer roll 1308, In some embodiments, the speed of the dispensing surface 1404 and the speed of the resin layer of resin coated backing 1314 are speed matched to each other within ±10 percent, ±5 percent, or ±1 percent, for example.

Various methods can be employed to transfer shaped abrasive particles 1302 from cavities 1402 of production tool 1350 to resin coated backing 1314. One method includes a pressure assist method where each cavity 1402 in production tooling 1350 has two open ends or the back surface or the entire production tooling 1350 is suitably porous and shaped abrasive particle transfer roll 1308 has a plurality of apertures and an internal pressurized source of air. With pressure assist, production tooling 1350 does not need to be inverted but it still may be inverted, Shaped abrasive particle transfer roll 1308 can also have movable internal dividers such that the pressurized air can be supplied to a specific arc segment or circumference of the roll to blow shaped abrasive particles 1302 out of the cavities and onto resin coated backing 1314 at a specific location. In some embodiments, shaped abrasive particle transfer roll 1308 may also be provided with an internal source of vacuum without a corresponding pressurized region or in combination with the pressurized region typically prior to the pressurized region as shaped abrasive particle transfer roll 1308 rotates. The vacuum source or region can have movable dividers to direct it to a specific region or arc segment of shaped abrasive particle transfer roll 1308. The vacuum can suck shaped abrasive particles 1302 firmly into cavities 1402 as the production tooling 1350 wraps shaped abrasive particle transfer roll 1308 before subjecting shaped abrasive particles 1302 to the pressurized region of shaped abrasive particle transfer roll 1308. This vacuum region be used, for example, with shaped abrasive particle removal member to remove excess shaped abrasive particles 1302 from dispensing surface 1404 or may be used to simply ensure shaped abrasive particles 1302 do not leave cavities 1402 before reaching a specific position along the outer circumference of the shaped abrasive particle transfer roll 1308.

After separating from shaped abrasive particle transfer roll 1308, production tooling 1350 travels along first web path 1304 back towards the shaped abrasive particle filling and excess removal section of the apparatus with the assistance of idler rolls 1310 as necessary. An optional production tool cleaner can be provided to remove stuck shaped abrasive particles still residing in cavities 1402 and/or to remove make coat resin transferred to dispensing surface 1404. Choice of the production tool cleaner can depend on the configuration of the production tooling and could be either alone or in combination, an additional air blast, solvent or water spray, solvent or water bath, an ultrasonic horn, or an idler roll the production tooling wraps to use push assist to force shaped abrasive particles 1302 out of the cavities 1402. Thereafter production tooling 1350 or belt advances to a shaped abrasive particle filling and excess removal section to be filled with new shaped abrasive particles 1302.

Various idler rolls 1310 can be used to guide the shaped abrasive particle coated backing 1311 having a predetermined, reproducible, non-random pattern of shaped abrasive particles 1302 on the first major surface that were applied by shaped abrasive particle transfer roll 1308 and held onto the first major surface by the make coat resin along second web path 1306 into an oven for curing the make coat resin. Optionally, a second shaped abrasive particle coater can be provided to place additional abrasive particles, such as another type of abrasive particle or diluents, onto the make coat resin prior to entry in an oven. The second abrasive particle coater can be a drop coater, spray coater, or an electrostatic coater as known to those of skill in the art. Thereafter a cured backing with shaped abrasive particles 1302 can enter into an optional festoon along second web path 1306 prior to further processing such as the addition of a size coat, curing of the size coat, and other processing steps known to those of skill in the art of making coated abrasive articles.

Although system 1300 is shown as including production tool 1350 as a belt, it is possible in some alternative embodiments for system 1300 to include production tool 1350 on vacuum pull roll 1308. For example, vacuum pull roll 1308 may include a plurality of cavities 1402 to which shaped abrasive particles 1302 are directly fed, Shaped abrasive particles 1302 can be selectively held in place with a vacuum, which can be disengaged to release shaped abrasive particles 1302 on backing 1314. Further details on system 1300 and suitable alternative may be found at US 2016/0311081, to 3M Company. St. Paul MN, the contents of which are hereby incorporated by reference.

Although shaped abrasive particles are used as an example, the system 1300 described above may also be used to accurately place non-shaped particles. Due to the configuration of the production tool 1350 placement of particles is very specifically controlled, and may be used to form patterns of a first level, second level, and higher despite the particles themselves not having any pre-determined shape. In one example, a blend of shaped and non-shaped particles may also be used. In selected examples, relatively precise placement of non-shaped particles, using methods and equipment described above may be used to form one or more patterns, in a similar manner to patterns formed through placement of shaped particles of the abrasive article, etc. It is recognized that the example abrasive articles described herein can include precisely-shaped particles, non-shaped particles or a combination thereof.

One or more camouflaging or masking layers can be created on the abrasive article using at least one colored layer to cover a portion of the size coat layer. The at least one colored layer can include one or more colors that are markedly different from a color of the size coat layer. The camouflaging layer can be discontinuous on the abrasive article since it does not cover all of the size coat layer. For purposes herein, the size coat layer can refer to an outermost layer of the abrasive article before the camouflaging layer is applied. In some examples, the abrasive article includes one size coat layer that provides functional grinding properties to the article. In other examples, the abrasive article includes more than one size coat layer that provides functional properties to the article; and in such examples, a second size coat layer can also be referred to as a supersize coat. For purposes herein, the term "size coat" or "size coat layer" can refer to both a single size coat layer and one or more size coat layers.

In some examples, the camouflaging layer can be applied as a repeating pattern of one or more colors on the abrasive article. In some examples, the camouflaging layer can be applied randomly to the abrasive article. The camouflaging layer can be used to mask or minimize an appearance of any imperfections on the abrasive article, such as unfilled or mis-filled particle positions, or to otherwise mask or minimize portions of the abrasive article that are without any particles, such as for example, one or more splices on an abrasive belt. Such design of abrasive articles having a camouflaging or masking layer can be applicable to abrasive articles in the form of sheets, discs, belts, pads, or rolls. Such design can be applicable to coated abrasive articles and non-woven abrasive articles.

In describing a position of the particles relative to other particles, for purposes herein, the term "adjacent" refers to particles that are next to each other in different rows, and the term "neighboring" or "neighbor" refers to particles that are next to each other in the same row. Each particle can be described as having a unique lateral, longitudinal position on the abrasive article. The figures described below include examples of an abrasive article in the form of a disc and a belt. In an example in which the abrasive article is a belt or a sheet, the article can be defined as having one or more longitudinal axes or longitudinal positions, which can be defined relative to a length of the article, and one or more lateral axes or lateral positions, which can be defined relative to a width of the article. In an example, in which the abrasive article is a disc, the disc can similarly be defined for purposes herein as having longitudinal positions that extend radially from a center point of the disc and lateral positions that can be formed by concentric circles formed around the center point of the disc. Concentric circles on the disc can have shared longitudinal positions that create longitudinal rows on the disc.

Figure 6:
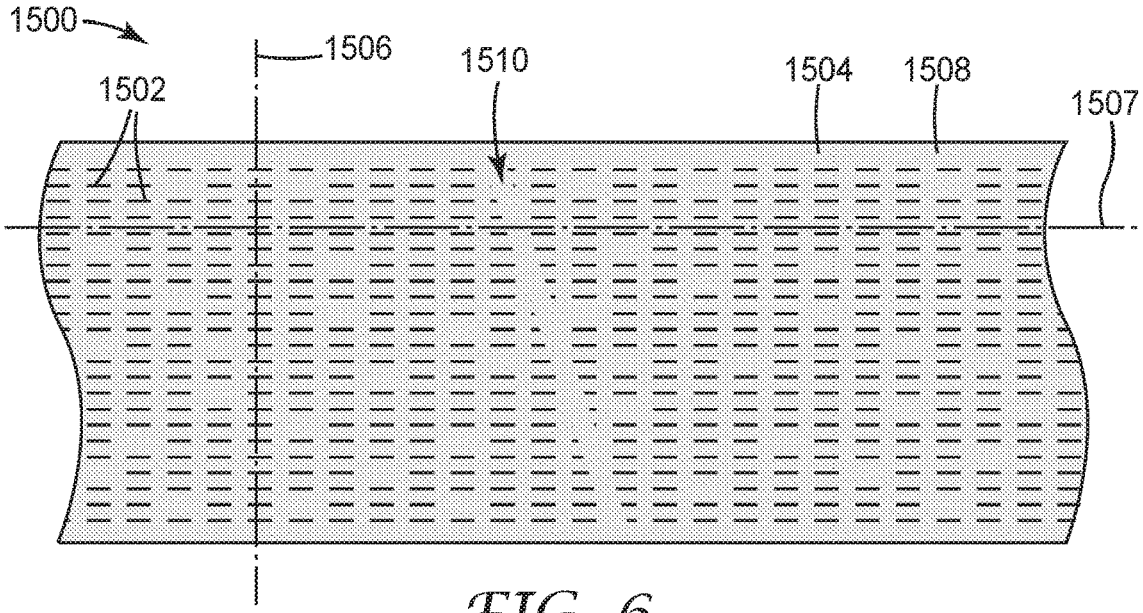
FIG. 6 is a top view of a coated abrasive belt.

FIG. 6 shows an abrasive article 1500 in the form of a belt or sheet. The belt 1500 can comprise a plurality of particles 1502, such as ceramic particles, attached to a backing substrate 1504. The specified z-direction rotational orientation positions the substantially planar surface of the backing substrate 1504 at an angle of approximately 0 degrees to a longitudinal axis 1506 of the belt 1500. For simplicity, each individual shaped abrasive particle is represented as a short line segment representative of the position of the base (sloping sidewall) of the shaped abrasive particle attached to the make coat.

As shown and described above in reference to FIG. 3B, the particles 1502 can be attached to the backing substrate 1504 via an adhesive or make coat, and a size coat 1508 can then be applied to further attach or adhere the particles 1502 to the backing substrate 1504. The size coat 1508 can be considered a functional component of the abrasive article 1500. The size coat 1508 can be applied as a continuous layer over essentially all of one side of the backing substrate 1504. In an example, the continuous size coat layer 1508 can comprise a color such that a color of the size coat becomes the color of the abrasive article 1500 (on at least the side of the abrasive article 1500 having the abrasive particles 1502). In an example, the color of the size coat 1508 can be drab or dull, such as, for example, a brown or rust color. However, it is recognized that any color can be used for the continuous size coat layer 1508.

The pattern created by the plurality of particles 1502 on the backing substrate 1504 can comprise a plurality of parallel lines that can be described as longitudinal rows of particles that are generally parallel to the longitudinal axis 1506. The pattern of particles 1502 can also comprise a plurality of parallel lines that can be described as lateral rows of particles that are generally parallel to a lateral axis 1507. In FIG. 6, the particles 1502 are generally aligned laterally and longitudinally relative to one another.

As shown in FIG. 6, the belt 1500 can include one or more gaps in the pattern where a particle 1502 is missing from an intended position on the backing substrate 1504 where a particle 1502 was intended to be placed. Given the volume of particles intended for placement on the backing substrate 1504, the small size of the particles 1502, as well as other factors, it is common that there can be unfilled or irregularly filled positions (or gaps) on the belt 1500. Such gaps can randomly occur on the backing substrate 1504 and their particular location and frequency can vary. In addition, the belt 1500 can include a void 1510 caused by a splice during processing.

A camouflaging layer or layers, when applied to the abrasive article, may guide or draw the eye away from the micro pattern of the particles 1502. Through use of a camouflaging pattern, the unintended gaps in particle placement and the void 1510 can be masked or downplayed, or otherwise minimized, when the user looks at the belt 1500 as a whole. Examples of different types of camouflaging layers for a coated abrasive article are described below and shown in FIGS. 7-9 and 11-12. An example of a camouflaging layer for a non-woven abrasive article is described below and shown in FIG. 14.

Figure 7A:
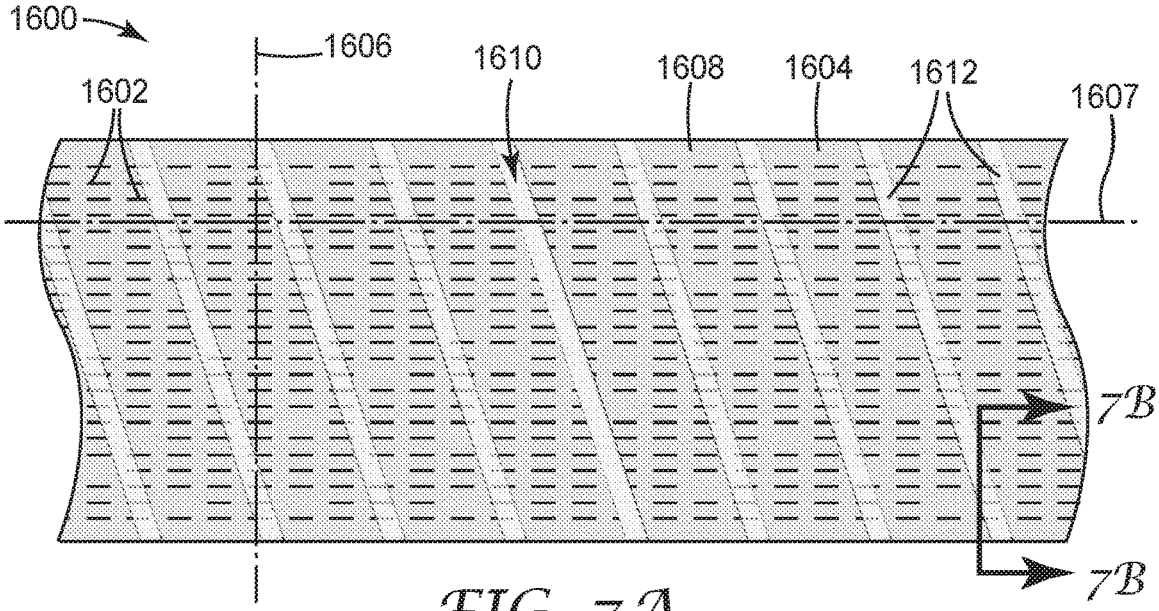
FIG. 7A is a top view of a coated abrasive belt having a camouflaging layer in accordance with various embodiments.

FIG. 7A shows an abrasive article 1600 in the form of a belt or sheet. The belt 1600 can comprise a plurality of particles 1602, such as ceramic particles, attached to a backing substrate 1604. The specified z-direction rotational orientation positions the substantially planar surface of the backing substrate 1604 at an angle of approximately 0 degrees to a longitudinal axis 1606 of the belt 1600. For simplicity, each individual shaped abrasive particle is represented as a short line segment representative of the position of the base (sloping sidewall) of the shaped abrasive particle attached to the make coat. The article 1600 can also include a lateral axis 1607. Similar to the particles 1502 of FIG. 6, the particles 1602 can be arranged in a pattern of longitudinal rows and lateral rows.

The belt 1600 can include a discontinuous layer applied over the size coat layer in a repeating pattern to form a macro pattern on the belt 1600. The discontinuous layer can include a second color that is different than the first color of the size coat layer. The second color can be in high contrast to the first color. In an example, as it is shown in FIG. 7A, the discontinuous layer can be applied as a plurality of diagonal lines 1612 extending across the belt 1600. In an example, the diagonal lines 1612 can each be oriented at an angle of about 30 degrees, relative to the longitudinal axis 1606. In other examples, the diagonal lines 1612 can be oriented at an angle of greater or less than 30 degrees, relative to the longitudinal axis 1606 or relative to a lateral axis 1607. The diagonal lines 1612 can be oriented at any angle relative to the axes 1606, 1607. Although the diagonal lines 1612 are shown at the same angle in FIG. 7, one or more of the diagonal lines 1612 can be oriented at different angles relative to one another. In an example, the belt 1600 includes ten diagonal lines 1612. In other examples, more or less lines 1612 can be included on the belt 1600.

The diagonal lines 1612 can be oriented on the backing substrate 1604 such that one of the diagonal lines 1612 can overlay a void 1610 on the backing substrate 1604 caused by a splice during processing. The diagonal line 1612 over the void 1610 can mask the absence of particles on the substrate 1604 in the area of the void 1610. Similarly, the other occurrences of the diagonal line 1612 can guide the eye away from the micro pattern of the particles 1602 and mask any unfilled or mis-filled positions on the substrate 1604.

Figure 7B:
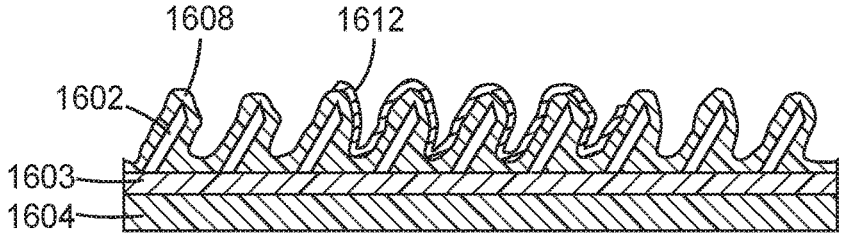
FIG. 7B is a cross section view of the coated abrasive belt of FIG. 16 in accordance with various embodiments.

FIG. 7B is a cross-sectional view of the belt 1600 to illustrate that the discontinuous layer 1612 can be applied over the continuous size coat layer 1608 such that portions of the belt 1600 can include a discontinuous layer two layers applied over a portion of the size coat layer 1608 covering the particles 1602. FIG. 7B also includes a make coat 1603 between the backing substrate 1604 and the particles 1062. As described above, the continuous size coat layer 1608 shown in FIG. 7B can be one size coat layer or two or more size coat layers—such as a first size coat layer and a second supersize coat layer applied over the first size coat layer.

In an example, the discontinuous layer 1612 can be a second size coat layer and provide functional properties to the abrasive article 1600. In other examples, the discontinuous layer 1612 can be a functional or non-functional layer in terms of the abrasive properties (grinding) and abrading performance of the article 1600. Various examples of the discontinuous layer 1612 can provide combinations of functional and non-functional properties, depending on the particle material and how it is applied to the abrasive article 1600. Regardless of whether the discontinuous layer 1612 is functional or not in terms of grinding, the discontinuous layer can provide an aesthetic function to the article 1600. The discontinuous layer 1612 can be applied to the article 1600 using various methods, including those methods used for applying the continuous size coat layer 1608 over the particles 1602. A thickness of the discontinuous layer 1612 on the article 1600 can be generally uniform or vary. The thickness can be such that it provides the above described masking effect, but not too thick that it disrupts the abrading process. In an example, the thickness can be less than 10 centimeters. In an example, the discontinuous layer 1612 can initially be formed as a slurry and then sprayed over the size coat 1608 using a spray coating process. In an example, the discontinuous layer can be applied using lasers and various types of printing (ink-jet, laser-jet, screen printing, etc.).

For the discontinuous layer 1612 to be effective at drawing the eye away from the void 1610 or any unfilled/mis-filled particle positions on the substrate 1604, the discontinuous layer 1612 can be a markedly different color than the first color of the continuous size coat layer. The second color can be described herein as being in high contrast to the first color such that the human eye can register and detect the color difference easily. In an example in which the first color is a drab color, such as a brown or rust color, the second color can be bright in contrast, such as white or silver, for example. In an example in which the first color is black, the second color can be a light or bright color, such as yellow or green.

The first and second color can also be described herein in terms of their respective wavelength on a visible color spectrum. The color spectrum is a portion of the electromagnetic spectrum that is visible to the human eye. Typically, the human eye can see color over wavelengths ranging from about 400 nanometers to 700 nanometers, or alternatively from about 380 nanometers to 800 nanometers. The wavelengths of visible light can be categorized into the following colors—red, orange, yellow, green, blue, indigo and violet. Although different technical sources provide some variability in the wavelength range for each color, an example is included in Table 1 below, as provided from: https://sciencestruck.com/wavelength-of-visible-light-spectrum.

TABLE 1

Wavelengths of visible light

| Color | Wavelength (nm) |
|---|---|
| Violet | 380-450 |
| Indigo | 420-450 |
| Blue | 450-495 |
| Green | 495-570 |
| Yellow | 570-590 |
| Orange | 590-620 |
| Red | 620-750 |

In an example, the first and second colors can be described herein as being separated by a wavelength of at least 100 nm on the visible light spectrum. In other examples, the first and second colors can be separated by a wavelength of at least 150 nm, and in yet other examples, at least 200 nm. In other examples, the colors can be formed by any combination of wavelengths.

For purposes herein, when describing the colors of the continuous size coat layer and the discontinuous layer applied to a portion thereof, white and black are also colors.

Figure 8:
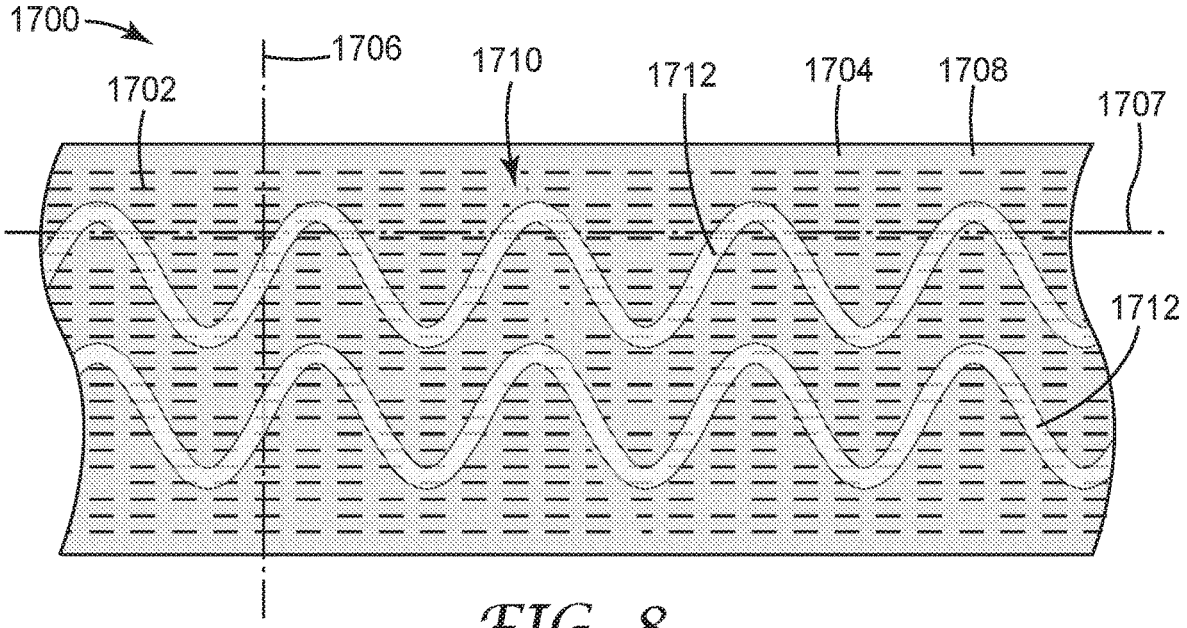
FIG. 8 is a top view of a coated abrasive belt having a camouflaging layer in accordance with various embodiments.

FIG. 8 shows an abrasive article 1700 in the form of a belt or sheet. The belt 1700 can include a plurality of particles 1702 that can be arranged on a backing substrate 1704 as similarly described above in reference to the belts 1500 and 1600 of FIGS. 6 and 7A, respectively. The belt 1700 can include a longitudinal axis 1706 and a lateral axis 1707.

The belt 1700 can include a discontinuous layer applied over the size coat layer in a repeating pattern to form a macro pattern on the belt 1700. The discontinuous layer can be applied as one or more waves 1712 that can each extend laterally across the belt 1700. The one or more waves 1712 can be formed of a second color that is different than the first color of the size coat layer. Although a void 1710 on the backing substrate 1704 is not completely covered by the waves 1712, the waves 1712 can create a larger pattern on the backing substrate 1704 that can draw the eye away from the void 1710. The waves 1712 can also draw the eye away from any missing particles in the micro pattern of the particles 1702. In other examples, more or less waves 1712 can be included as compared to the two waves 1712 shown in FIG. 8. In other examples, the waves can extend longitudinally across the abrasive article 1700 rather than laterally as shown in FIG. 8.

In another example, the belt can include a discontinuous layer having a second color and a third color. The second color can be applied to the continuous size coat layer as described above. The third color can be applied to the portions of the second color or the third color can be directly applied to the continuous size coat layer. The second and third colors can be applied in the same pattern or in different patterns. For example, referring back to FIG. 7A, the diagonal lines can be in an alternating pattern of a second color and a third color. Referring back to FIG. 8, the first of the two waves 1712 can be the second color and the second of the two waves 1712 can be the third color. The second and third colors can both be in high contrast to the first color of the continuous size coat layer. In an example, the second and third colors can be in high contrast or markedly different from one another. Such difference can be defined, for example, in terms of a wavelength difference on the visible color spectrum of at least 100 nanometers.

Figure 9:
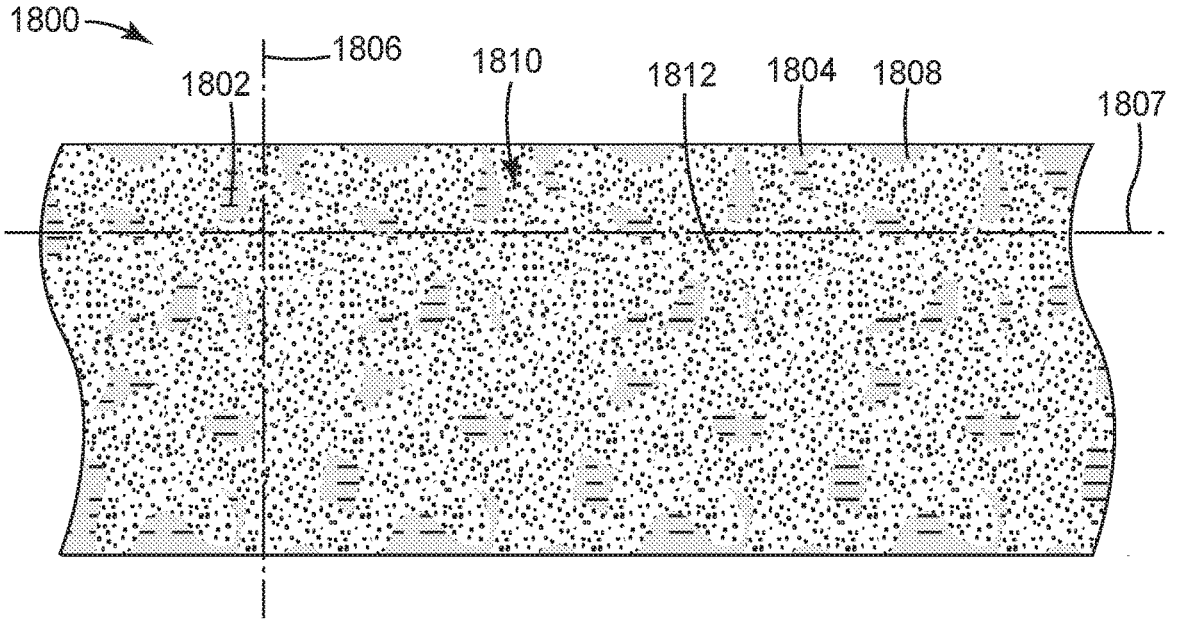
FIG. 9 is a top view of a coated abrasive belt having a camouflaging layer in accordance with various embodiments.

FIG. 9 shows an abrasive article in the form of a belt or sheet 1800, having a longitudinal axis 1806 and a lateral axis 1807, and which can be similarly configured to the belts 1600 and 1700 in terms of particle placement. Instead of a repeating pattern for the discontinuous layer, the discontinuous layer in the belt 1800 can be randomly applied over the size coat layer. In an example, the discontinuous layer 1812 can provide a thin coating that covers a majority of the size coat layer 1808 but not an entirety of the size coat layer 1808. In FIG. 9, the size coat layer 1808 is visible along random portions of the belt 1800 where the discontinuous layer 1812 is not applied. As also shown in FIG. 9, in an example, the discontinuous layer 1812 can have a speckled pattern on the article 1800 that can be created by the presence of two or more colors in the discontinuous layer 1812. Such speckled pattern can contribute to a camouflaging effect of the discontinuous layer 1812. The speckles are not necessarily drawn to scale in FIG. 9 but are intended to show that the discontinuous layer 1812 can contain more than one color within the coating such that, when applied, two or more colors are visible for the discontinuous layer 1812. The two or more colors of the discontinuous layer 1812 can be in high contrast to one another or in high contrast to the color of the size coat layer 1808. In another example, the discontinuous layer 1812 can include only one color and such color can be in high contrast to the color of the size coat layer 1808.

The discontinuous layer 1812 can be thinly or sparingly applied to the article 1800 such that the discontinuous layer 1812 does not saturate the surface and instead provides partial coverage of the discontinuous layer 1812 on the size coat layer. The specific coverage of the discontinuous layer can vary across the article 1800 such that the color of the size coat is more visible on particular areas of the article 1800 compared to other areas. In an example, a slurry can be created of the material used to form the discontinuous layer 1812 and the slurry can be applied via a spray coat process. Void 1810 is labeled in FIG. 9 to coincide with a location of the splice on the belt 1800; however, the void 1810 is largely masked in FIG. 9 by the discontinuous speckled layer 1812.

In another example, instead of applying the discontinuous layer directly to the size coat layer, the size coat layer (a first continuous layer) can be covered with another continuous, but not necessarily functional layer (a second continuous layer) in terms of grinding. The discontinuous layer can then be applied over a portion of the second continuous layer. In an example, the second continuous layer can be a bright color (such as white) and the discontinuous layer can include one or more colors in high contrast to the color of the second continuous layer. In another example, the size coat layer can include two layers—a first size coat layer and a second size coat layer, which can be also be referred to as a supersize coat layer. The non-functional continuous layer can be applied over the second size coat layer and then the discontinuous layer can be applied over a portion of the non-functional continuous layer.

It is recognized that the abrasive articles described herein, having one or more camouflaging layers, can include any type of pattern or random application of the one or more camouflaging layers to the abrasive article. The one or more camouflaging layers can include a single color that can be in high contrast to the color of the size coat layer. In an example, the camouflaging layers can include two different colors, both of which can be in high contrast to the color of the size coat layer. The second and third colors can also be in high contrast to one another.

The one or more camouflaging layers described herein can be used to mask any imperfections in the particle placement on the backing substrate of an abrasive article. In FIGS. 15-18 the particles are shown in a pattern of lateral and longitudinal alignment and there can be gaps in which particles can randomly be missing (i.e. the position on the backing substrate is unfilled). In another example, the particles can be arranged in a staggered linear pattern. Referring back to FIG. 15, the rows of particles can be aligned longitudinally and staggered laterally such that particles 1516 in adjacent longitudinal rows can be laterally misaligned or staggered relative to one another, or the particles can be aligned laterally and staggered longitudinally such that particles 1516 in adjacent lateral rows can be longitudinally misaligned or staggered relative to one another. Reference is made to provisional application Ser. No. 62/780,987 filed Dec. 18, 2018, titled "STAGGERED LINEAR PATTERN." In other examples, the one or more camouflaging layers described herein can be used in combination with randomly-placed particles.

Figure 10:
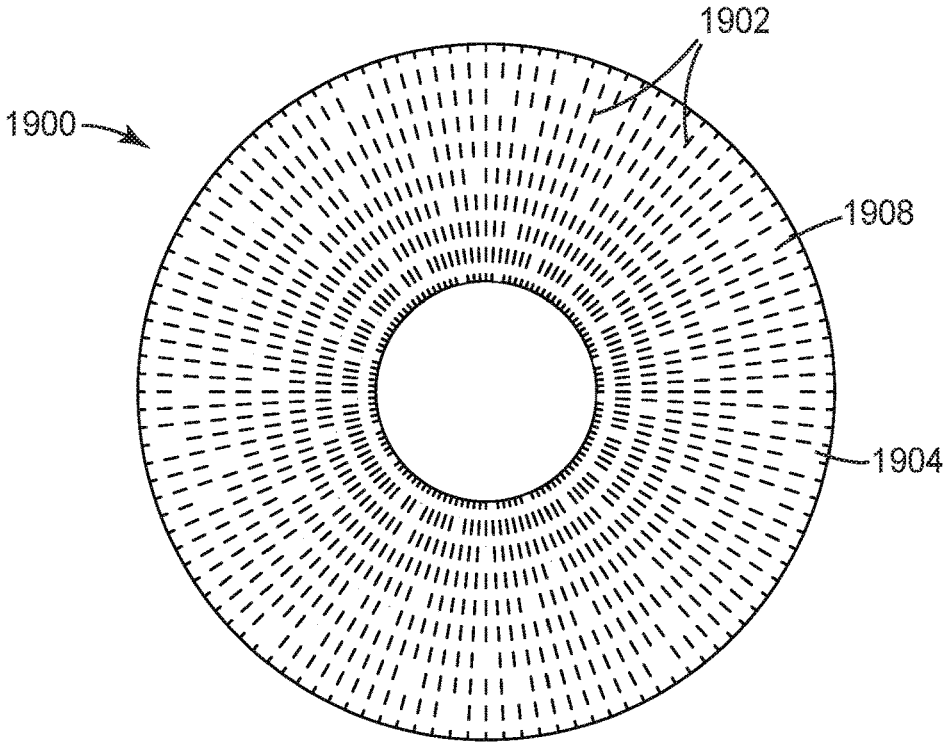
FIG. 10 is atop view of a coated abrasive disc.

FIG. 10 shows an abrasive article 1900 in the form of a disc. The disc 1900 can comprise a plurality of particles 1902, such as ceramic particles, attached to a backing substrate 1904. The specified z-direction rotational orientation positions the substantially planar surface of the backing substrate 1904 circumferentially and a pattern created by the plurality of particles 1902 comprises a plurality of concentric circles. The disc 1900 can be described for purposes herein as having longitudinal positions, which extend radially from a center point of the disc 1900, and lateral positions, which correspond to the concentric circles formed around the center point of the disc 1900. For simplicity, each individual shaped abrasive particle is represented as a short line segment representative of the position of the base (sloping sidewall) of the shaped abrasive particle attached to the make coat. In an example, and as shown in FIG. 10, adjacent particles can be arranged closer to one another near the center point of the disc 1900 and the spacing between adjacent particles can increase as the particles extend radially from the center point of the disc 1900.

The plurality of particles 1902 can be arranged on the disc 1900 such that at least a portion of the particles in the plurality of particles 1902 are aligned longitudinally and laterally relative to other particles 1902 on the disc 1900. The particles 1902 can be attached to the backing substrate 1904 using a continuous size coat layer 1908. A color of the size coat layer 1908 can thus form the color of the disc 1900, at least on the side of the disc 1900 containing the particles 1902. As similar described above in reference to the belt of FIG. 6, the disc 1900 can include gaps where a particle 1902 is missing from a position on the backing substrate 1902 where a particular was intended to be placed. As it is shown in FIG. 10, the disc 1900 does not include a splice, but a void resulting from a splice could be present on the disc 1900 in other examples.

Figure 11:
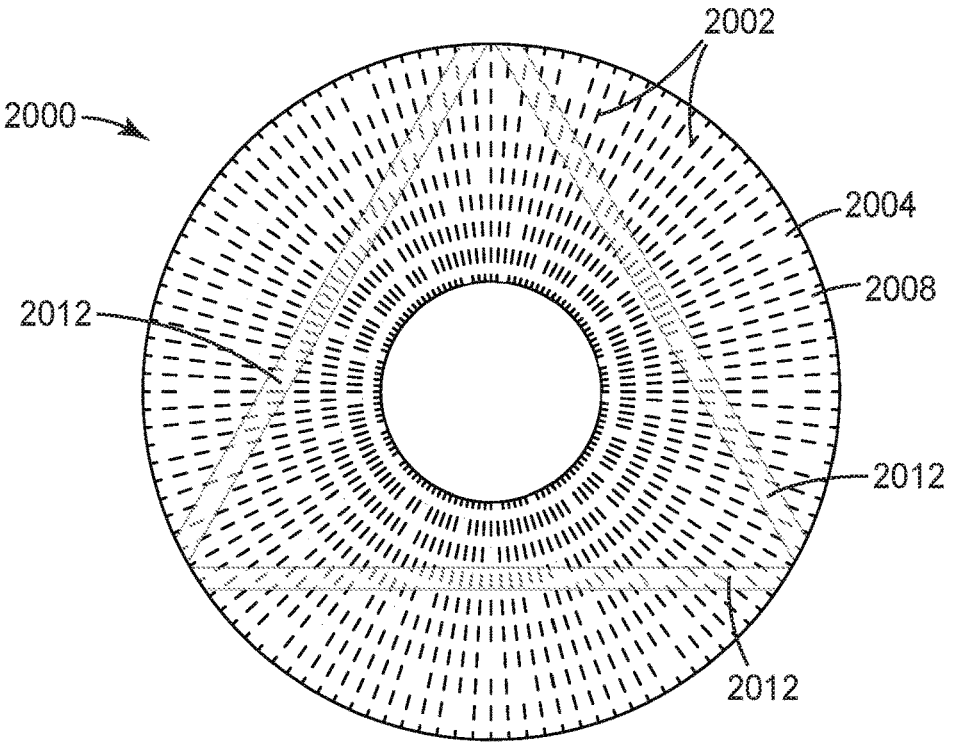
FIG. 11 is a top view of a coated abrasive disc having a camouflaging layer in accordance with various embodiments.

FIG. 11 shows an abrasive article 2000 in the form of a disc. The disc 2000 can comprise a plurality of particles 2002, such as ceramic particles, attached to a backing substrate 2004 in a similar manner as described above in reference to the disc 1900 of FIG. 10. The belt can include a discontinuous layer that can be applied over a portion of the size coat layer. The discontinuous layer on the disc 2000 can include a plurality of line segments 2012 that can extend across the disc 2000 to form a triangular shape on the disc 2000. The line segments 2012 can be applied to the disc 2000 to mask any unintended gaps in particle placement, as well as any voids created by a splice on the disc 2000. It is recognized that in other examples, the disc 2000 can include more or less line segments 2012. For example, three additional line segments 2012 could be added to the triangular shape of FIG. 11 such that the discontinuous layer formed could be a six-point star. As described above in reference to FIGS. 7-9, the discontinuous layer can include one or more colors that are markedly different from the first color of the size coat layer.

Figure 12:
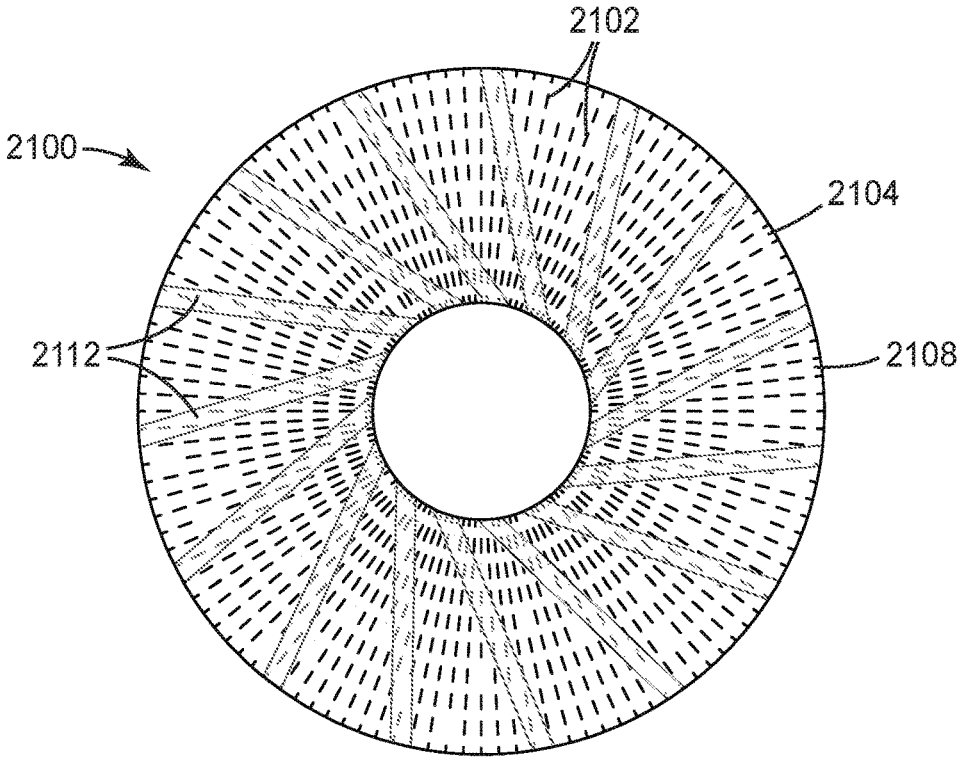
FIG. 12 is a top view of a coated abrasive disc having a camouflaging layer in accordance with various embodiments.

FIG. 12 shows an abrasive article 2100 in the form of a disc. The disc 2100 is provided as another example article having a discontinuous 2112 layer applied over a portion of the size coat layer 2108 on the disc 2100. In the example of FIG. 12, the discontinuous layer 2112 can include a plurality of line segments 2112 extending from a center point of the disc 2100 and extending around the disc 2100 in a generally counterclockwise direction. This is just another example of the various types of discontinuous layers that can be used on the abrasive article to guide the eye away from a micro pattern of the particles on the disc 2100. The specific number and placement of the line segments 2112 can vary.

The one or more camouflaging layers are described above for use in abrasive articles having particles arranged in patterns. It is recognized that the micro pattern of the particles can extend across some or all of the abrasive article. It is recognized that the one or more camouflaging layers described above can also be used on coated abrasive articles in which some or all of the particles are randomly placed on the abrasive article and the particles are not arranged to form a micro pattern.

It is recognized that FIGS. 6-12 may not necessarily be drawn to scale. The particles on the example belts and discs may be more or less compact, relative to one another, than what is shown in FIGS. 6-12. The spacing between neighboring particles or adjacent particles can depend on the intended density of the particles on the disc or belt. It is recognized that different abrasive products can have different target densities.

Figure 13:
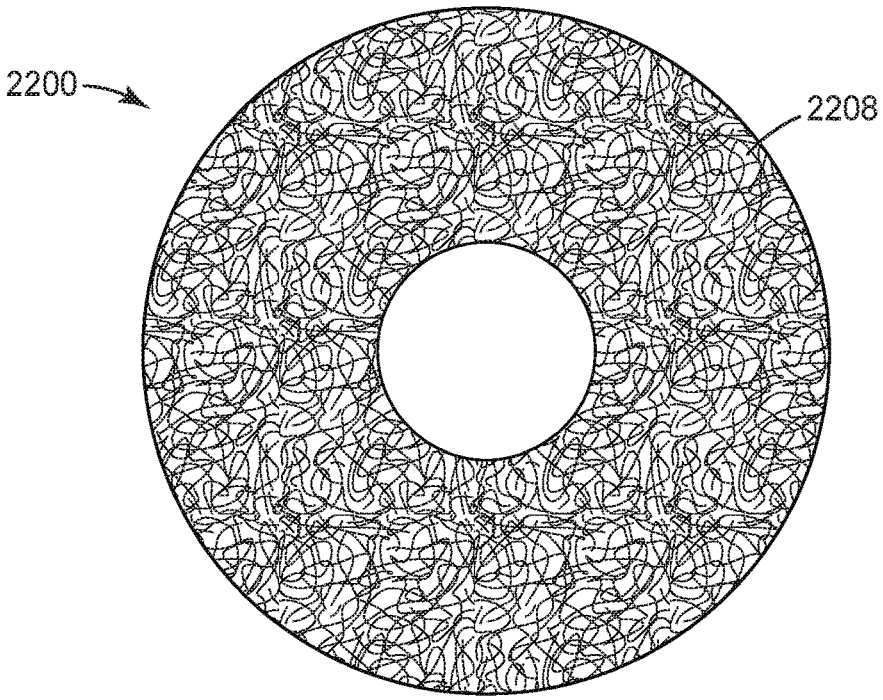
FIG. 13 is a top view of a non-woven abrasive disc.

In addition to a coated abrasive article, the one or more camouflaging layers described herein can be applied to a non-woven abrasive article. FIG. 13 is a top view of an example non-woven abrasive article 2200 in the form of a disc. The non-woven abrasive disc 2200 can include a nonwoven fiber web formed of intertwined fibers. A slurry of abrasive particles and binder can be mixed with the nonwoven fiber web to form the abrasive article and a size coat 2208 can be applied thereto.

Figure 14:
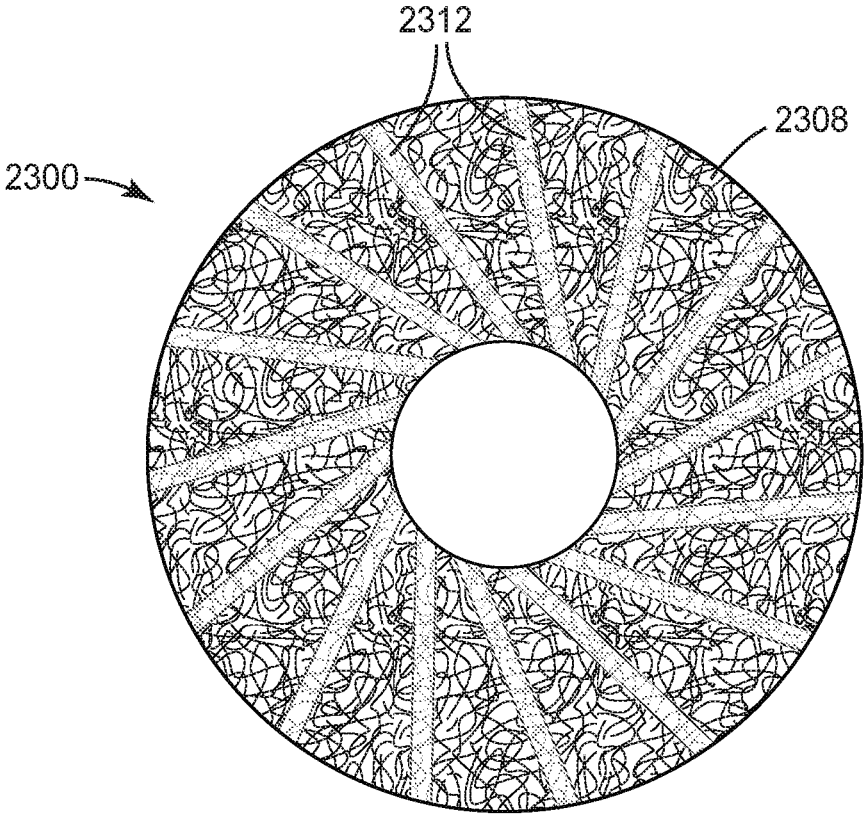
FIG. 14 is a top view of a non-woven abrasive disc having a camouflaging layer in accordance with various embodiments.

FIG. 14 is a top view of an example non-woven abrasive article 2300 in the form of a disc. The disc 2300 can include a discontinuous layer 2312 that can be applied over a portion of the continuous size coat layer 2308, and the discontinuous layer 2312 can serve as a camouflaging or masking layer. The discontinuous layer 2312 can include a plurality of line segments 2312 extending from a center point of the disc. FIG. 14 shows one example of a non-woven abrasive article with a camouflaging layer, but it is recognized that various designs and configurations of the camouflaging layer can be used on the non-woven abrasive article, including those provided above in regard to the coated abrasive discs and belts.

In an example, abrasive articles having a camouflaging layer can include precisely-shaped particles, non-shaped particles, or a combination thereof. In an example, the abrasive articles can include coated, shaped abrasive particles and at least a portion of the shaped abrasive articles can have a similar size and geometry. In an example, the shaped abrasive particles can include triangular-shaped particles (described above in detail as an equilateral triangle conforming to a truncated pyramid), tetrahedral-shaped particles or a combination thereof. In an example, the abrasive articles can include non-woven fibers that form a non-woven abrasive article. It is recognized that the camouflaging layer described herein can extend across some or all of the abrasive article.

FIGS. 7-9, 11, 12 and 14 provide example abrasive articles having one or more camouflaging layers and illustrate that the camouflaging layers can be applied in a variety of patterns or randomly. It is recognized that the one or more camouflaging layers can be applied in any number of ways to create any number of patterns or random designs on the abrasive article in order to create a masking effect on the abrasive article and distract from any particle imperfections on the abrasive article. As another example, the one or more camouflaging layers can include a discontinuous layer that can form an alphanumeric marking or pattern on the abrasive article. Such alphanumeric marking can cover a small portion or a majority of the abrasive article, and such alphanumeric marking can occur once on the abrasive article or repeat across a portion of the abrasive article.

It is recognized that the one or more camouflaging layers can be applied over particles that can be arranged randomly or in any number of patterns. The particles can be arranged on the backing substrate in lateral alignment, longitudinal alignment or both. The particles can be arranged in a staggered linear pattern. The particles can be arranged in a macro pattern created by one or more micro patterns of the particles and the one or more camouflaging layers can be applied over the macro pattern. Reference is made to provisional application Ser. No. 62/780,988 filed Dec. 18, 2018, titled "MACRO PATTERN FOR ABRASIVE ARTICLES."

EXAMPLES

Various embodiments of the present disclosure can be better understood by reference to the following Examples which are offered by way of illustration. The present disclosure is not limited to the Examples given herein.

Example 1 provides an abrasive article comprising an abrasive material, a continuous size coat layer applied to the abrasive material and covering essentially all of a first side of the abrasive article, and a discontinuous layer applied to a portion of the first side of the abrasive material and covering a corresponding portion of the continuous size coat layer. The continuous size coat layer can comprise a first color. The discontinuous layer can comprise a second color different than the first color.

Example 2 provides the abrasive article of Example 1 optionally configured wherein the discontinuous layer is applied as a repeating pattern on the portion of the abrasive material.

Example 3 provides the abrasive article of Example 1 optionally configured wherein the discontinuous layer is applied randomly on the abrasive material.

Example 4 provides the abrasive article of any one of Examples 1-3 optionally configured wherein the abrasive material comprises a plurality of abrasive particles attached to a backing substrate with an adhesive.

Example 5 provides the abrasive article of Example 4 optionally configured wherein the plurality of abrasive particles are arranged in one or more patterns on the backing substrate, the one or more patterns comprising at least one of longitudinally aligned particles or laterally aligned particles.

Example 6 provides the abrasive article of any one of Examples 1-5 optionally configured wherein the discontinuous layer is a second size coat layer applied over a portion of the continuous size coat layer.

Example 7 provides the abrasive article of any one of Examples 1-6 optionally configured wherein the discontinuous layer comprises a third color different than the first and second colors.

Example 8 provides the abrasive article of any one of Examples 1-3 optionally configured wherein the abrasive material comprises non-woven fibers bonded together with a resin.

Example 9 provides the abrasive article of any one of Examples 1-8 optionally further comprising a continuous intermediate layer applied over the continuous size coat layer, and the discontinuous layer is applied directly over a portion of the continuous intermediate layer.

Example 10 provides the abrasive article of Example 9 optionally configured wherein the continuous intermediate layer comprises a third color different from the first and second colors.

Example 11 provides the abrasive article of any one of Examples 9 or 10 optionally configured wherein the continuous intermediate layer is white.

Example 12 provides the abrasive article of any one of Examples 9-11 optionally configured wherein the second color is a color on a visible light spectrum.

Example 13 provides the abrasive article of any one of Examples 1-2 optionally configured wherein the second color is a high contrast color relative to the first color.

Example 14 provides the abrasive article of Example 13 optionally configured wherein the first color and second color are separated by a wavelength of at least 150 nm on a visible light spectrum.

Example 15 provides an abrasive article comprising a backing substrate, a plurality of particles attached to the backing substrate, an adhesive for attaching the particles to the backing substrate, a continuous size coat layer applied to the plurality of particles and covering essentially all of a first side of the backing substrate, the continuous size coat layer comprising a first color, and a discontinuous layer applied to less than an entirety of the first side of the backing substrate to cover a portion of the size coat layer. The discontinuous layer can comprise a second color different from the first color, and the second color is in high contrast to the first color.

Example 16 provides the abrasive article of Example 15 optionally configured wherein the discontinuous layer is a second size coat layer applied over a portion of the continuous size coat layer.

Example 17 provides the abrasive article of any one of Example 15 or 16 optionally configured wherein the discontinuous layer comprises a third color different from the first and second colors, the third color in high contrast to at least one of the first and second colors.

Example 18 provides the abrasive article of any one of Examples 15-17 optionally configured wherein the discontinuous layer is applied to the first side of the backing substrate in a repeating pattern, and the repeating pattern forms a macro pattern on the abrasive article.

Example 19 provides the abrasive article of any one of Examples 15-18 optionally configured wherein the continuous size coat layer includes a first size coat layer and a second size coat layer applied over the first size coat layer.

Example 20 provides the abrasive article of any one of Examples 15-19 optionally configured wherein the first color is black or white.

Example 21 provides the abrasive article of any one of Examples 15-20 optionally configured wherein the second color is a color on a visible light spectrum.

Example 22 provides the abrasive article of any one of Examples 15-21 optionally configured wherein the first and second colors are colors visible on a visible light spectrum and separated by at least 200 nm on the visible light spectrum.

Example 23 provides the abrasive article of any one of Examples 15-22 optionally configured wherein the plurality of particles are arranged in a repeating pattern on the backing substrate.

Example 24 provides the abrasive article of Example 23 optionally configured wherein the plurality of particles are arranged in longitudinal rows on the backing substrate.

Example 25 provides the abrasive article of Example 24 optionally configured wherein the discontinuous layer comprises a pattern repeating laterally on the backing substrate.

Example 26 provides the abrasive article of any one of Examples 15-22 optionally configured wherein the discontinuous layer is randomly applied to the first side of the backing substrate.

Example 27 provides the abrasive article of any one of Examples 15-26 optionally configured wherein the plurality of particles comprises crushed particles without a precise shape, precisely-shaped particles, and a combination thereof.

Example 28 provides the abrasive article of Example 27 optionally configured wherein at least one of the precisely-shaped particles comprises a first side and a second side separated by a thickness t, the first side comprises a first face having a triangular perimeter and the second side comprises a second face having a triangular perimeter, wherein the thickness t is equal to or smaller than the length of the shortest side-related dimension of the particle.

Example 29 provides the abrasive article of Example 28 optionally further comprising at least one sidewall connecting the first side and the second side.

Example 30 provides the abrasive article of Example 29 optionally configured wherein the at least one sidewall is a sloping sidewall.

Example 31 provides the abrasive article of Example 27 optionally configured wherein at least one of the precisely-shaped particles is tetrahedral and comprises four faces joined by six edges terminating at four tips, each one of the four faces contacting three of the four faces.

Example 32 provides the abrasive article of Example 31 optionally configured wherein at least one of the four faces is substantially planar.

Example 33 provides the abrasive article of any one of Example 31 or 32 optionally configured wherein at least one of the four faces is concave.

Example 34 provides the abrasive article of any one of Examples 31-33 optionally configured wherein at least one of the four faces is convex.

Example 35 provides the abrasive article of any one of Examples 15-34 optionally configured wherein a z-direction rotational angle about a line perpendicular to a major surface of the backing substrate and passing through individual particles of the plurality of particles is substantially the same for a portion of the plurality of particles.

Example 36 provides the abrasive article of any one of Examples 15-35 optionally configured wherein the backing substrate is a belt.

Example 37 provides the abrasive article of any one of Examples 15-35 optionally configured wherein the backing substrate is a disc.

Example 38 provides a method of forming an abrasive article with a camouflaging layer, the method comprising: forming an abrasive article having an abrasive material, applying a continuous size layer to the abrasive material and covering essentially all of a first side of the abrasive article, and applying a discontinuous layer to a portion of the first side of the abrasive article and covering a corresponding portion of the continuous size coat layer. The continuous size coat layer can comprise a first color and the discontinuous layer comprises a second color different than the first color, the second color in high contrast to the first color.

Example 39 provides the method of Example 38 optionally configured wherein forming the abrasive article comprises aligning a plurality of particles in one or more patterns, transferring the one or more patterns to a backing substrate containing a layer of adhesive, and curing the adhesive to attach the plurality of particles to the backing substrate in the one or more patterns.

Example 40 provides the method of Example 39 optionally configured wherein aligning the plurality of particles in one or more patterns comprises aligning the plurality of particles into one or more longitudinal rows and one or more lateral rows.

Example 41 provides the method of any one of Examples 38-40 optionally configured wherein forming the abrasive article comprises bonding a plurality of non-woven fibers together with a resin to form a non-woven abrasive article.

Example 42 provides the method of any one of Examples 38-41 optionally configured wherein applying the discontinuous layer to a portion of the first side of the abrasive article comprises applying the discontinuous layer in a repeating pattern, and the repeating pattern forms a macro pattern on the abrasive article.

Example 43 provides the method of any one of Example 38-41 optionally configured wherein applying the discontinuous layer to a portion of the first side of the abrasive article comprises randomly applying the discontinuous layer to the abrasive article.

Example 44 provides an article or method of any one or any combination of Examples 1-43, which can be optionally configured such that all steps or elements recited are available to use or select from.

The terms and expressions that have been employed are used as terms of description and not of limitation, and there is no intention in the use of such terms and expressions of excluding any equivalents of the features shown and described or portions thereof, but it is recognized that various modifications are possible within the scope of the embodiments of the present disclosure. Thus, it should be understood that although the present disclosure has been specifically disclosed by specific embodiments and optional features, modification and variation of the concepts herein disclosed may be resorted to by those of ordinary skill in the art, and that such modifications and variations are considered to be within the scope of embodiments of the present disclosure.

Various aspects of the disclosure have been described. These and other aspects are within the scope of the following claims.

What is claimed is:

1. An abrasive article comprising:

an abrasive material comprising a plurality of abrasive particles attached to a backing substrate with an adhesive, wherein the plurality of abrasive particles are arranged in one or more patterns on the backing substrate, the one or more patterns comprising at least one of longitudinally aligned particles or laterally aligned particles;

a continuous size coat layer applied to the abrasive material and covering essentially all of a first side of the abrasive article, the continuous size coat layer comprising a first color; and a discontinuous layer applied to a portion of the first side of the abrasive material and covering a corresponding portion of the continuous size coat layer, wherein the discontinuous layer comprises a second color different than the first color, and wherein the discontinuous layer is applied as a repeating pattern on the portion of the abrasive material.

2. The abrasive article of claim 1, wherein the discontinuous layer comprises a third color different than the first and second colors.

3. The abrasive article of claim 1, wherein the abrasive material comprises non-woven fibers bonded together with a resin.

4. The abrasive article of claim 1 further comprising a continuous intermediate layer applied over the continuous size coat layer, and the discontinuous layer is applied directly over a portion of the continuous intermediate layer.

5. The abrasive article of claim 4, wherein the continuous intermediate layer comprises a third color different from the first and second colors.

6. The abrasive article of claim 4, wherein the continuous intermediate layer is white.

7. The abrasive article of claim 6, wherein the second color is a color on a visible light spectrum.

8. The abrasive article of claim 1, wherein the second color is a high contrast color relative to the first color.

9. The abrasive article of claim 8, wherein the first color and second color are separated by a wavelength of at least 150 nm on a visible light spectrum.

10. An abrasive article comprising:

an abrasive material comprising a plurality of abrasive particles attached to a backing substrate with an adhesive, wherein the plurality of abrasive particles are arranged in one or more patterns on the backing substrate, the one or more patterns comprising at least one of longitudinally aligned particles or laterally aligned particles;

a continuous size coat layer applied to the abrasive material and covering essentially all of a first side of the abrasive article, the continuous size coat layer comprising a first color; and a discontinuous layer applied to a portion of the first side of the abrasive material and covering a corresponding portion of the continuous size coat layer, wherein the discontinuous layer comprises a second color different than the first color, and wherein the discontinuous layer is a second size coat layer applied over a portion of the continuous size coat layer.

11. An abrasive article comprising:

a backing substrate;

a plurality of particles attached to the backing substrate, wherein the plurality of particles are arranged in a repeating pattern on the backing substrate;

an adhesive for attaching the particles to the backing substrate;

a continuous size coat layer applied to the plurality of particles and covering essentially all of a first side of the backing substrate, the continuous size coat layer comprising a first color; and a discontinuous layer applied to less than an entirety of the first side of the backing substrate to cover a portion of the size coat layer, wherein the discontinuous layer comprises a second color different from the first color, and the second color is in high contrast to the first color, and wherein the discontinuous layer is a second size coat layer applied over a portion of the continuous size coat layer.

12. The abrasive article of claim 11, wherein the discontinuous layer comprises a third color different from the first and second colors, the third color in high contrast to at least one of the first and second colors.

13. The abrasive article of claim 11, wherein the discontinuous layer is applied to the first side of the backing substrate in a repeating pattern, and the repeating pattern forms a macro pattern on the abrasive article.

14. The abrasive article of claim 11, wherein the continuous size coat layer includes a first size coat layer and a second size coat layer applied over the first size coat layer.

15. The abrasive article of claim 11, wherein the first color is black or white.

16. The abrasive article of claim 15, wherein the second color is a color on a visible light spectrum.

17. The abrasive article of claim 11, wherein the first and second colors are colors visible on a visible light spectrum and separated by at least 200 nm on the visible light spectrum.

18. The abrasive article of claim 11, wherein the plurality of particles are arranged in longitudinal rows on the backing substrate.

19. The abrasive article of claim 18, wherein the discontinuous layer comprises a pattern repeating laterally on the backing substrate.

20. The abrasive article of claim 11, wherein the discontinuous layer is randomly applied to the first side of the backing substrate.

21. The abrasive article of claim 11, wherein a z-direction rotational angle about a line perpendicular to a major surface of the backing substrate and passing through individual particles of the plurality of particles is substantially the same for a portion of the plurality of particles.

* * * * *